US006360199B1

(12) United States Patent
Yokoyama

(10) Patent No.: US 6,360,199 B1
(45) Date of Patent: Mar. 19, 2002

(54) SPEECH CODING RATE SELECTOR AND SPEECH CODING APPARATUS

(76) Inventor: Atsushi Yokoyama, c/o Oki Electric Industry Co., Ltd. 7-12, Toranomon 1-chome, Minato-ku, Tokyo (JP)

( * ) Notice: Subject to any disclaimer, the term of this patent is extended or adjusted under 35 U.S.C. 154(b) by 0 days.

(21) Appl. No.: 09/327,631

(22) Filed: Jun. 8, 1999

(30) Foreign Application Priority Data

Jun. 19, 1998 (JP) ..... 10-172559

(51) Int. Cl.[7] ..... G10L 11/06; G10L 11/02; G10L 21/02

(52) U.S. Cl. ..... 704/214; 704/233; 704/229; 704/226

(58) Field of Search ..... 704/233, 208, 704/210, 214, 215, 226, 229, 211, 212, 216, 220, 227, 228, 230, 200, 201

(56) References Cited

U.S. PATENT DOCUMENTS

| | | | | | |
|---|---|---|---|---|---|
| 4,672,669 | A | * | 6/1987 | DesBlanche et al. | 381/46 |
| 5,765,127 | A | * | 6/1998 | Nishiguchi et al. | 704/208 |
| 5,778,338 | A | * | 7/1998 | Jacobs et al. | 704/223 |
| 5,878,388 | A | * | 3/1999 | Nishiguchi et al. | 704/214 |
| 5,960,388 | A | * | 9/1999 | Nishiguchi et al. | 704/208 |
| 5,991,718 | A | * | 11/1999 | Malah | 704/233 |
| 6,202,046 | B1 | * | 3/2001 | Oshikiri et al. | 704/233 |

FOREIGN PATENT DOCUMENTS

| | | | |
|---|---|---|---|
| JP | 1-233498 | 9/1989 | G10L/9/18 |
| JP | 06021900 | 1/1994 | H04B/14/04 |
| JP | 06282297 | 10/1994 | G10L/9/00 |
| JP | 08254989 | 10/1996 | G10L/3/00 |
| JP | 9-8680 | 10/1997 | H04B/1/10 |

* cited by examiner

*Primary Examiner*—Richemond Dorvil

(57) ABSTRACT

A speech coding rate selector includes: a speech input unit for receiving an input speech; a short-term power arithmetic unit for computing the power of an input speech at a predetermined time unit; an ambient noise power estimating unit for estimating the power of an ambient noise superimposed on an input speech; a rate selection threshold value arithmetic unit for computing a group of power threshold values for selecting a speech coding rate; a power comparator for selecting one appropriate rate from among a plurality of speech coding rates; an ambient noise property inferring unit for inferring the property of an ambient noise superimposed on an input speech; and a comparison power corrector for correcting an output value of the short-term power arithmetic unit if an ambient noise, the property of which has been inferred by the ambient noise property inferring unit, proves to exhibit a considerable time-dependent change in power. A speech coding apparatus includes a speech input unit for receiving an input speech; a speech coding rate selector for selecting an appropriate speech coding rate according to the power of an input speech; a speech analyzer for processing input speech to estimate a transfer function of a speaker's oral cavity; a speech coding unit that makes a synthesis filter based on the transfer function of the oral cavity and codes an excitation signal of the synthesis filter on the basis of an estimation result supplied by the speech analyzer; and a gain suppressor for

15 Claims, 20 Drawing Sheets

BLOCK DIAGRAM OF SPEECH CODING RATE SELECTOR OF FIRST OPERATIVE EXAMPLE

BLOCK DIAGRAM OF SPEECH CODING RATE SELECTOR OF FIRST OPERATIVE EXAMPLE

BLOCK DIAGRAM OF BASIC CONFIGURATION OF SPEECH CODING RATE SELECTOR

RESULT OF CONVENTIONAL SPEECH CODING RATE SELECTION

BLOCK DIAGRAM OF COMPARISON POWER CORRECTOR

BLOCK DIAGRAM OF AMBIENT NOISE PROPERTY INFERRING UNIT

OPERATION OF MAXIMUM POWER VALUE CHASER

GRAPH SHOWING THE OPERATIONS OF MAX. POWER VALUE CHASER AND MIN. POWER VALUE CHASER

BLOCK DIAGRAM OF VOICED PERIOD DETERMINER

OPERATIONAL TIMECHART OF FOURTH OPERATIVE EXAMPLE

BLOCK DIAGRAM OF SLOW CHANGE AMOUNT EXTRACTOR

BLOCK DIAGRAM OF SPEECH CODING RATE SELECTOR OF SIXTH OPERATIVE EXAMPLE

BLOCK DIAGRAM OF SPEECH CODING RATE SELECTOR OF SEVENTH OPERATIVE EXAMPLE

BLOCK DIAGRAM OF SPEECH CODING RATE SELECTOR OF EIGHTH OPERATIVE EXAMPLE

BLOCK DIAGRAM OF SPEECH CODING RATE SELECTOR OF NINTH OPERATIVE EXAMPLE

BLOCK DIAGRAM OF THRESHOLD VALUE CORRECTOR

BLOCK DIAGRAM OF THRESHOLD VALUE CORRECTOR

BLOCK DIAGRAM OF SPEECH CODING RATE SELECTOR OF TWELFTH OPERATIVE EXAMPLE

BLOCK DIAGRAM OF THRESHOLD VALUE CORRECTOR

BLOCK DIAGRAM OF THRESHOLD VALUE CORRECTOR

BLOCK DIAGRAM OF SPEECH CODING RATE SELECTOR OF FIFTEENTH OPERATIVE EXAMPLE

BLOCK DIAGRAM OF HANGOVER PROCESSOR

BLOCK DIAGRAM OF SPEECH CODING APPARATUS OF SIXTEENTH OPERATIVE EXAMPLE

BLOCK DIAGRAM OF GAIN SUPPRESSOR

BLOCK DIAGRAM OF CONFIGURATION EXAMPLE OF
GAIN SUPPRESSION UPDATING AMOUNT ARITHMETIC UNIT

SPEECH CODING RATE SELECTOR AND SPEECH CODING APPARATUS suppressing the gain of a signal supplied from the speech input unit to the speech coding unit.

BACKGROUND OF THE INVENTION

1. Field of the Invention

The present invention relates to a variable coding rate speech coding apparatus and a speech coding rate selector used with a portable telephone, an internet telephone, etc.

2. Description of the Related Art

There has been proposed a high-efficiency speech coding apparatus for compressing data to be transmitted through a portable telephone or the like. A portable telephone based on the code division multiple access (CDMA) system has become commercially practical that makes the speech coding rate variable to control an average coding rate as low as possible thereby to accommodate more subscribers.

The speech coding apparatus with variable coding rate is adapted to determine the presence of a speech by a speaker by a speech detector and to employs a higher coding rate while the speaker is speaking (hereinafter referred to as a "voiced period") so as to maintain higher speech quality. On the other hand, speech coding apparatus with the variable coding rate employs a lower coding rate while the speaker is silent (hereinafter referred to as an "unvoiced period") thereby to reduce the average coding rate. The section that selects the speech coding rate as mentioned above in the speech coding apparatus with the variable coding rate is designated a speech coding rate selector (Related literature: TIA/EIA/IS-96B: Speech Service Option Standard for Wideband Spread Spectrum Systems).

In designing the aforesaid speech coding rate selector, the performance of the speech detector for distinguishing the voiced period from the unvoiced period is an important factor. The speech detector is required to accurately detect the voice of a speaker (hereinafter referred to as "speech") among diverse acoustic signals entered through a microphone such as a portable telephone. The biggest obstacle in detecting speech is a variety of ambient noises coming into the microphone in the environment where the portable telephone is located. Such ambient noises include, for example, an engine noise and a noise produced by the wind hitting the car windows in case of a traveling car, and train running noises in a station premise or the like. These noises enter the speech detector as ambient noises, frequently causing the speech detector to misjudge them as speech. For this reason, when a portable telephone is used in an environment with loud ambient noises, the speech detector erroneously determined an unvoiced period as a voiced period, resulting in an excessively high speech coding rate. This has caused uncomfortable sound to be produced at a receiver side and also caused a subscriber capacity to be reduced in an entire portable telephone system or the power consumed by a portable telephone terminal to be increased.

Conversely, there have been cases where speaker's speech is misjudged as an ambient noise in an environment with loud ambient noises. The low coding rate mode of the speech coding apparatus with the variable coding rate is incapable of performing coding while maintaining sufficiently high speech quality. In some cases, the speech gain is suppressed to reduce the audibility of ambient noises during an unvoiced period. Hence, misjudgment of speech as an ambient noise causes the speech coding apparatus with variable coding rate to operate at the low coding rate, leading to markedly deteriorated speech quality.

Hitherto, in order to solve the problems described above, there has been proposed a method in which a noise eliminator or a noise suppressor (hereinafter referred to as "noise eliminators or the like") is installed in a stage preceding the speech detector, and this method has proved to be effective to a certain extent. Many of these noise eliminators or the like, however, require a system having a large circuit scale or arithmetic processing as in the fast Fourier transform (FFT). This has frequently adversely affected an attempt to reduce the size and power consumption of portable telephone terminals.

SUMMARY OF THE INVENTION

Accordingly, an object of the present invention is to provide a speech coding rate selector and a speech coding apparatus that do not require a large-scale circuit or arithmetic processing.

To this end, a speech coding rate selector in accordance with the present invention has: a speech input unit for receiving an input speech; a short-term power arithmetic unit for computing the power of input speech at a predetermined time unit; an ambient noise power estimating unit for estimating the power of an ambient noise superimposed on an input speech; a rate selection threshold value arithmetic unit for computing a power threshold value group for selecting a speech coding rate from the result of the ambient noise power estimation; a power comparator that compares the power determined by the short-term power arithmetic unit with the threshold value group determined by the rate selection threshold value arithmetic unit to select one appropriate rate from among a plurality of speech coding rates; an ambient noise property inferring unit for inferring the property of an ambient noise superimposed on an input speech; and a comparison power corrector for correcting an output value of the short-term power arithmetic unit if an ambient noise inferred by the ambient noise property inferring unit proves to exhibit great time-dependent variation in power.

The speech coding apparatus has: a speech input unit for receiving input speech; a speech coding rate selector for selecting an appropriate speech coding rate according to the power of input speech; a speech analyzer for processing input speech to estimate a transfer function of a speaker's oral cavity; a speech coding unit that makes a synthesis filter based on the transfer function of the oral cavity according to the estimation result supplied by the speech analyzer and codes an excitation signal of the synthesis filter; and a gain suppressor that is inserted between the speech input unit and the speech coding unit and suppresses the gain of a signal supplied from the speech input unit to the speech coding unit in an unvoiced period according to the information from the speech coding rate selector.

DESCRIPTION OF THE PREFERRED EMBODIMENT

The embodiments of the present invention will now be described using operative examples.

FIRST OPERATIVE EXAMPLE

Figure 1:
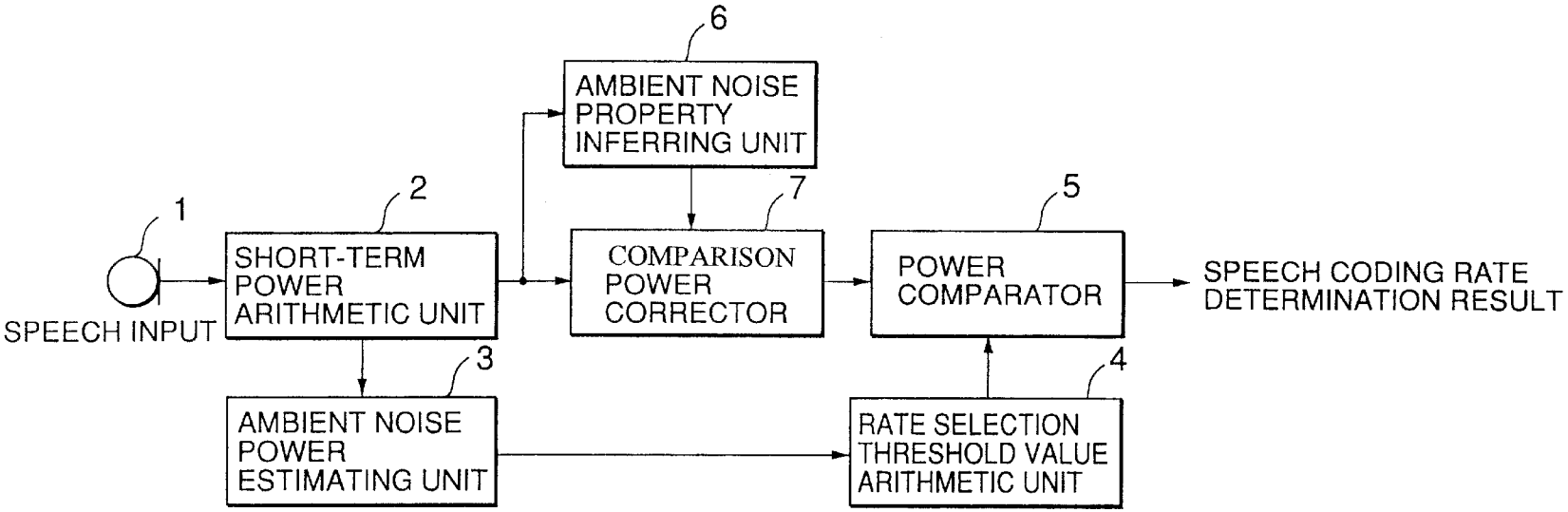
FIG. 1 is a block diagram showing a speech coding rate selector of a first operative example.

FIG. 1 is a block diagram showing a speech coding rate selector of a first operative example.

Before referring to FIG. 1, a description will be given of the basic configuration and basic function of the speech coding rate selector.

Figure 2:
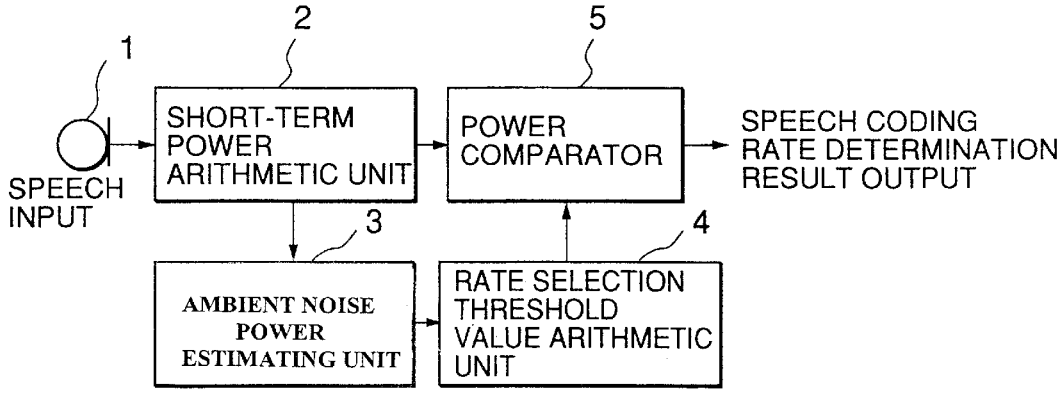
FIG. 2 is a block diagram of the basic structure of a general speech coding rate selector.

FIG. 2 is a block diagram showing the basic configuration of a general speech coding rate selector.

A speech input unit 1 receives input speech signals through a microphone or the like. A short-term power arithmetic unit 2 computes the power of an input speech at every time unit (hereinafter referred to as "frame") for selecting a speech coding rate, that is, it computes an average or total power of one frame of an input signal. An ambient noise power estimating unit 3 estimates the power of an ambient noise superimposed on an input speech. A rate selection threshold value arithmetic unit 4 employs the estimation result of the ambient noise power to compute a power threshold value group for selecting a speech coding rate. The power threshold value will be discussed hereinafter. A power comparator 5 compares the power determined by the short-term power arithmetic unit 2 with the threshold value group determined by the rate selection threshold value arithmetic unit 4 to select one appropriate rate from among a plurality of speech coding rates.

It is assumed in this operative example that four types of speech coding rates, namely, 8 kilobits per second, 4 kilobits per second, 2 kilobits per second, and 1 kilobits per second, are available. Higher coding rates such as those of 8 kilobits or 4 kilobits per second are used in a voiced period, whereas the coding rates of 2 kilobits and 1 kilobits per second are used in an unvoiced period. In an apparatus having a function for suppressing speech signal levels, if the coding rates of 2 kilobits and 1 kilobits per second are selected as the results of the speech coding rate selection, then the function for suppressing speech signal levels is rendered valid.

The rate selection threshold value arithmetic unit 4 outputs three threshold values, T1, T2, and T3. As will be discussed hereinafter, the values of these threshold values T1, T2, and T3 are changed according to the power level of an ambient noise. The threshold values have an established relationship represented by T1>T2>T3. The power comparator 5 compares an output P of the short-term power arithmetic unit 2 with all threshold values, and selects the speech coding rate of 8 kilobits per second if P>T1, the speech coding rate of 4 kilobits per second if T1>P>T2, the speech coding rate of 2 kilobits per second if T2>P>T3, or the speech coding rate of 1 kilobits per second if T3 >P.

Figure 3:
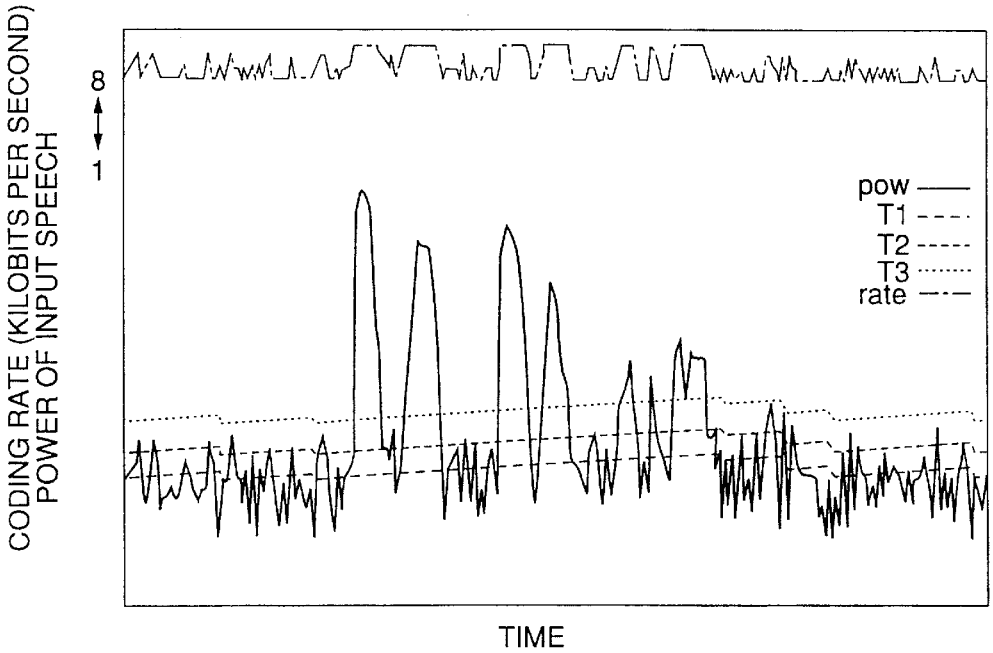
FIG. 3 is a schematic representation illustrative of the time-dependent changes in a short-term power arithmetic result pow, three rate selection threshold values T1, T2, and T3, and a speech coding rate selection result rate.

FIG. 3 shows the time-dependent changes in a short-term power arithmetic result pow, three rate selection threshold values T1, T2, and T3, and a speech coding rate selection result rate. The axis of abscissa indicates time, while the axis of ordinate indicates the power of an input speech. The line at the uppermost level indicates the rate selection results, wherein the axis of ordinate in this area indicates the rate.

The threshold values T1, T2, and T3 are changed nearly in proportion to the power level of an ambient noise so that they closely follow it. The threshold values T1, T2, and T3 are compared with the output of the short-term power arithmetic unit to select a coding rate.

In the first operative example, if the power of an ambient noise greatly varies with time, then the output of the short-term power arithmetic unit 2 is forcibly decreased in an unvoiced period so as to prevent a higher coding rate from being selected.

The apparatus shown in FIG. 1 consists of the apparatus shown in FIG. 2 to which the following new functional block has been added.

The description will be given of only the new block added to the apparatus of FIG. 1.

An ambient noise property inferring unit 6 functions to infer the property of an ambient noise superimposed on a speech entered through a microphone. A comparison power corrector 7 corrects an output value of the short-term power arithmetic unit 2 according to the property of the ambient noise to prevent a higher coding rate from being erroneously selected in an unvoiced period due to the ambient noise.

The ambient noise property inferring unit 6 infers the property of the ambient noise by receiving an output from the short-term power arithmetic unit 2, and it outputs a small value (e.g. a value close to 1) if the time-dependent change in the power of the ambient noise is small as in a white noise. Conversely, the ambient noise property inferring unit 6 outputs a large value (e.g. 1.5 to 2) if the ambient noise greatly varies in power with time as in the case of an automotive engine noise.

The comparison power corrector 7 adds very little correction to the output of the short-term power arithmetic unit 2 and supplies it to the power comparator 5 if the output value of the ambient noise property inferring unit 6 is small. If the output value of the ambient noise property inferring unit 6 is large, then the comparison power corrector 7 corrects the output of the short-term power arithmetic unit 2 so as to significantly attenuate the output of the short-term power arithmetic unit 2 (e.g. $1/1.5$ to $1/2$). Thus, the output value of the short-term power arithmetic unit 2 is adjusted so that it does not exceed the rate selection threshold value T1 or T2 and that the power comparator 5 does not select a higher coding rate in an unvoiced period. The threshold values T1, T2, and T3 may be controlled in the conventional manner.

On the other hand, if the output value of the ambient noise property inferring unit 6 is large, then the output of the short-term power arithmetic unit 2 is considerably corrected thereby to suppress the possibility of an inappropriate rate being selected due to the ambient noise. To be more specific, the output of the short-term power arithmetic unit 2 is attenuated to inhibit a higher coding rate from being selected in an unvoiced period or the output is passed through an adaptive low-pass filter to restrain the variation in the power for selecting a rate so as to inhibit the rate selection from changing very frequently.

The configurations and operations described above provide the following advantages:

1. If the property of an ambient noise is likely to cause the speech coding rate selector to make misjudgment, then the output of the short-term power arithmetic unit can be corrected so that it is sufficiently smaller than the threshold values for selecting a rate in an unvoiced period, thus making it possible to inhibit a wrong higher coding rate from being selected.

2. When a speech coding apparatus is provided with a function for suppressing a speech signal level by a lower coding rate, frequent change of the coding rate that causes switching between a state wherein the suppressing function is rendered valid and a state wherein the suppressing function is rendered invalid produces changes in level uncomfortable to ears. If the property of the ambient noise is likely to cause the speech coding rate selector to make misjudgment, then a correction can be made to cause the output of the short-term power arithmetic unit to smoothly change in an unvoiced period, thus achieving a reduction in the uncomfortable speech level variation.

3. In the example described above, the circuit scale is small, requiring a lower operational volume.

4. If the property of an ambient noise is unlikely to cause the speech coding rate selector to make misjudgment, then the similar operation to that of a conventional speech coding rate selector can be performed. This allows the speech coding rate to be equivalent to a conventional speech coding rate.

SECOND OPERATIVE EXAMPLE

In a second operative example, an example of the configuration of the comparison power corrector 7 used in the first operative example will be described.

Figure 4:
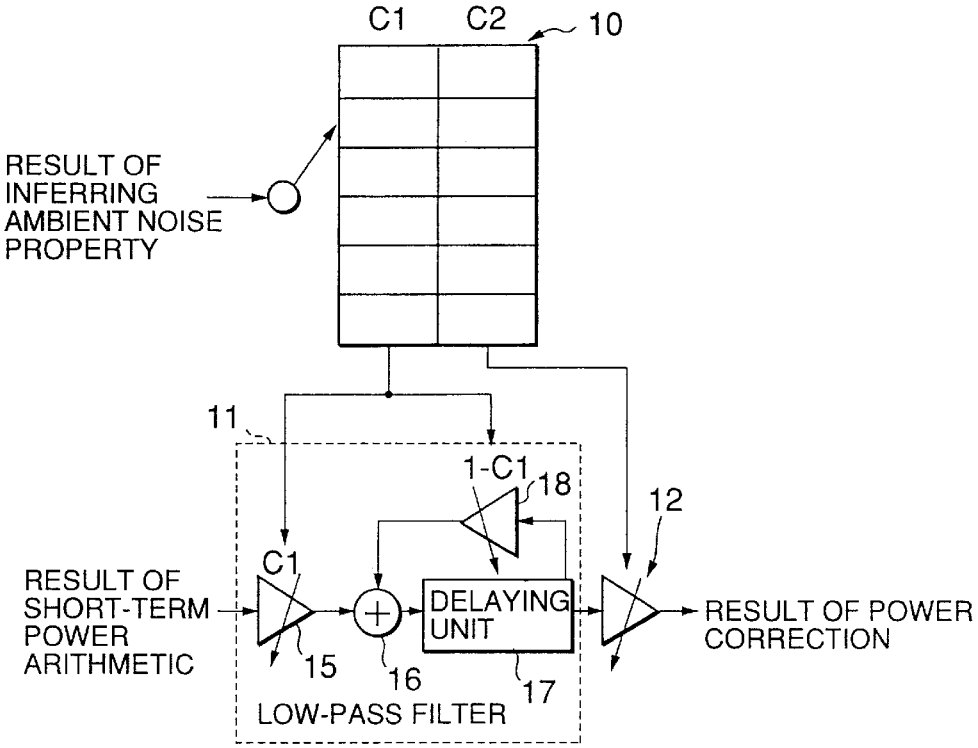
FIG. 4 is a block diagram showing an example of the configuration of a comparison power corrector.

FIG. 4 is a block diagram showing an example of the configuration of the comparison power corrector.

A table 10 is used to obtain two types of parameters C1 and C2 by searching the table from a result given by the ambient noise property inferring unit 6 of FIG. 1. The characteristics of a low-pass filter 11 change in accordance with the magnitude of the parameter C1. A level suppressor 12 changes a signal level suppression amount in accordance with the magnitude of the parameter C2.

The low-pass filter 11 is formed of a multiplying unit 15, an adder 16, a delayer 17, and a multiplying unit 18. An input signal is retained by the delayer 17 for one sampling time, and a part thereof is fed back by the multiplying unit 18 and added to the following input signal in the adder 16. The gains of the multiplying unit 15 and the multiplying unit 18 are adjusted so that they provide the parameters C1 and 1−C1 as shown in the drawing, which will be explained hereinafter.

The table 10 is searched using the result provided by the ambient noise property inferring unit 6 as an index to determine the parameters C1 and C2. The low-pass filter 11 eliminates a large portion of the high-frequency component from an input when the parameter C1 is small, while it eliminates a small portion of the high-frequency component from the input when C1 is large. Thus, a large portion of the high-frequency component of an output value of the short-term power arithmetic unit 2 is removed if the property of an ambient noise such as an automotive noise is likely to cause the apparatus to erroneously select a higher coding rate in an unvoiced period.

The level suppressor 12 multiplies the input value by the value of the parameter C2 and outputs the result. Thus, the output value of the short-term power arithmetic unit 2 is controlled to produce a small value that is then output to the power comparator 5 if the property of an ambient noise is likely to cause the apparatus to erroneously select a higher coding rate in an unvoiced period.

In the case of an automotive noise, the parameter C1 becomes smaller and a larger portion of the high-frequency component is removed from the output of the short-term power arithmetic unit 2. On the other hand, the parameter C2 becomes larger, and the output of the low-pass filter 11 is significantly suppressed by the level suppressor 12. In the case of a white noise, the output of the short-term power arithmetic unit 2 is output almost as it is to the power comparator 5.

The configuration and operation described above provide the following advantages:

1. If the property of an ambient noise is the one of such ambient noise as an automotive noise that is likely to cause the speech coding rate selector to make misjudgment in an unvoiced period, then a correction can be made so that the value supplied to the power comparator changes smoothly by eliminating a high-frequency component from an output of the short-term power arithmetic unit.

2. If the property of an ambient noise is likely to cause the speech coding rate selector to make misjudgment in an unvoiced period, then the output of the short-term power arithmetic unit can be corrected such that it is sufficiently smaller than the threshold values for selecting a rate so as to inhibit erroneous selection of a higher coding rate.

3. The table search enables processing to be accomplished with a small operational processing volume.

4. If the property of an ambient noise is the one of such noise as a white noise that is unlikely to cause the speech coding rate selector to make misjudgment, then an output result provided by the short-term power arithmetic unit can be output almost as it is to the power comparator.

THIRD OPERATIVE EXAMPLE

In a third operative example, an example of the configuration of the ambient noise property inferring unit 6 used in the first operative example will be described.

Figure 5:
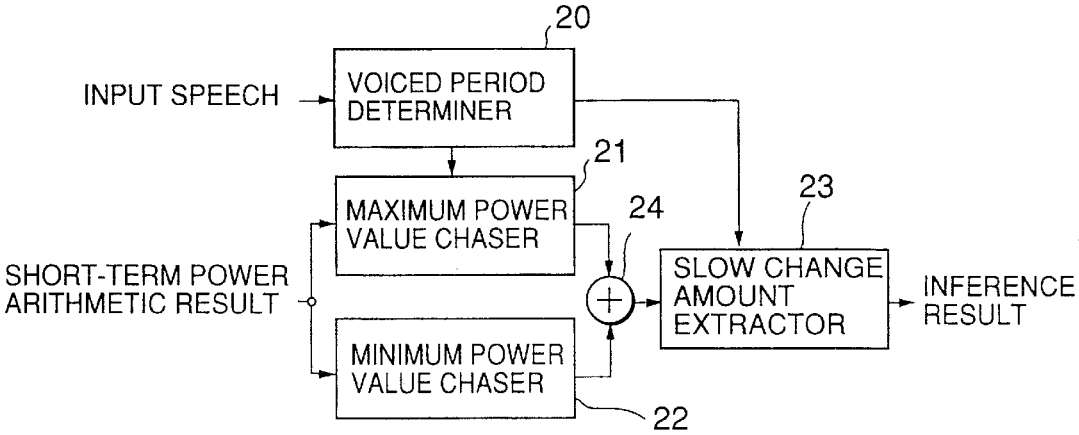
FIG. 5 is a block diagram showing an example of the configuration of an ambient noise property inferring unit.

FIG. 5 is a block diagram showing an example of the configuration of the ambient noise property inferring unit.

A voiced period determiner 20 functions to detect a voiced period by using a speech entered through a microphone. A maximum power value chaser 21 uses an output result supplied by the short-term power arithmetic unit 2 and a result supplied by the voiced period determiner 20 in order to chase a maximum power value of the input speech in an unvoiced period.

A minimum power value chaser 22 functions to chase a minimum power value of an input speech by using a result provided by the short-term power arithmetic unit 2. A slow change amount extractor 23 uses the voiced period determiner 20, and a differential signal of the results supplied by the maximum power value chaser 21 and the minimum power value chaser 22 in order to extract a component that slowly changes from the change of the differential signal of the maximum power value chaser 21 and the minimum power value chaser 22.

The voiced period determiner 20 evaluates input speech signals for each frame to decided whether the frame belongs the voiced period or the unvoiced period, then outputs the determination result as "voiced" or "unvoiced". The method for embodying this will be described in operative example 4 discussed hereinafter.

The maximum power value chaser 21 uses the outputs of the short-term power arithmetic unit 2 for each frame and the outputs of the voiced period determiner 20 to chase, on a time axis, only the change in the maximum values of the outputs of the short-term power arithmetic unit 2 during the unvoiced period from the steep change.

Figure 6:
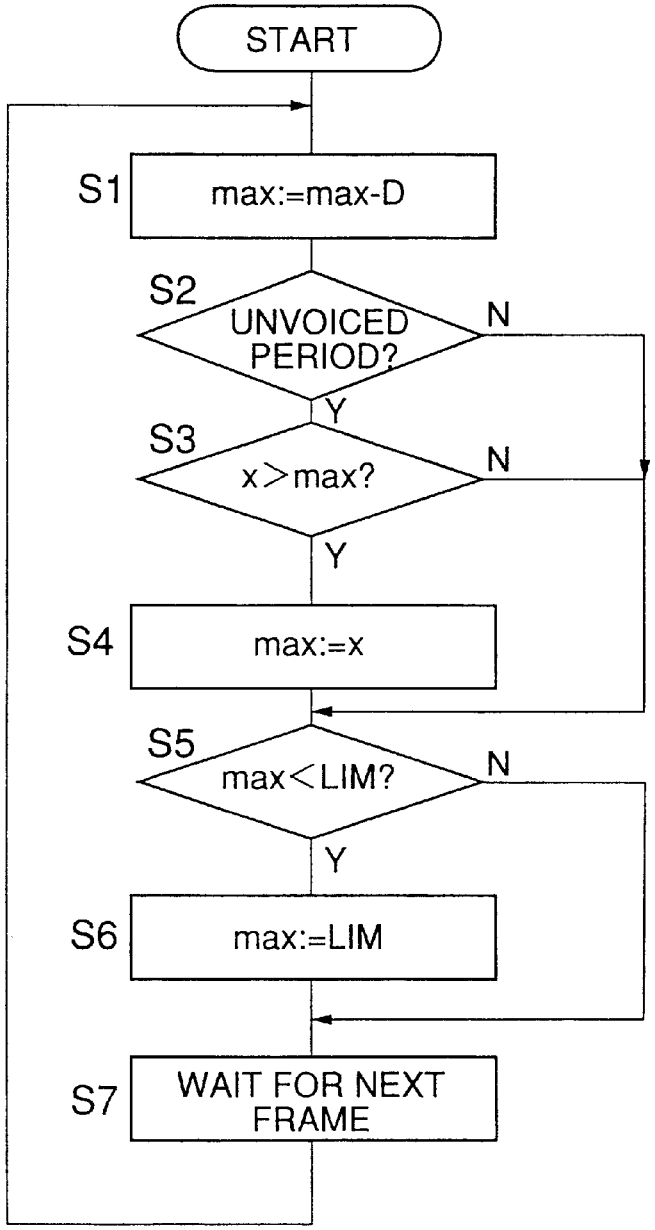
FIG. 6 is an operation flowchart of a maximum power value chaser (21).

FIG. 6 is an operation flowchart of the maximum power value chaser 21.

Symbol max denotes a maximum power value being chased, x denotes an input from the short-term power arithmetic unit, D denotes a small positive value, and LIM denotes a value for placing restrictions so that the value of max does not go below a certain value.

Step S1: Reduce max by a certain amount to update it by using D.

Step S2: Carry out determination for implementing the processing of S3 and S4 only in an unvoiced period.

Step S3: Compare x with max.

Step S4: If x is larger than max, then set the value of x as max.

Step S5: Implement the processing of S6 only if max is below LIM.

Step S6: If max is below LIM, then set max as LIM.

Step S7: Wait for the next frame because max for the present frame has been determined.

The minimum power value chaser 22 uses the outputs of the short-term power arithmetic unit 2 for each frame to chase, on a time axis, only the change in the minimum values from the steep change. The operation of the minimum power value chaser 22 is identical to that of the maximum power value chaser 21, so that the description thereof will not be repeated.

Figure 7:
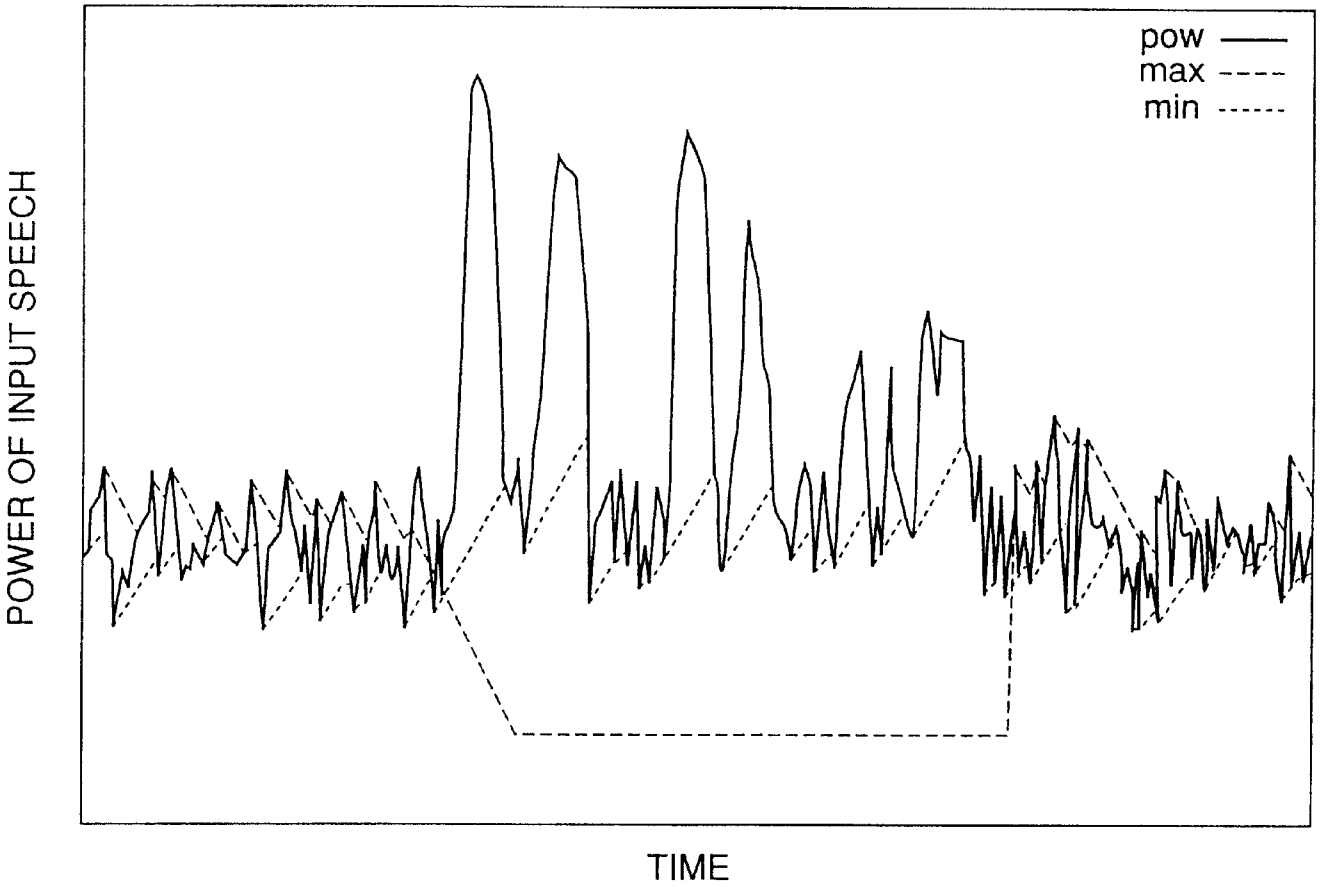
FIG. 7 is a schematic representation illustrative of the actual operations of the maximum power value chaser (21) and a minimum power value chaser (22).

FIG. 7 shows the actual operations of the maximum power value chaser 21 and the minimum power value chaser 22.

The result supplied by the short-term power arithmetic unit 2 is denoted by pow, the result of chasing the maximum value is denoted by max, and the result of chasing the minimum value is denoted by min. The axis of abscissa indicates time, while the axis of ordinate indicates power.

An adder 24 shown in FIG. 5 takes the difference between the output of the maximum power value chaser 21 and the output of the minimum power value chaser 22 and supplies the difference to the slow change amount extractor 23. In the case of a white noise, the change in the outputs of the adder 24 is small. In contrast to this, in the case of an automotive noise, the change in the outputs of the adder 24 increases. The outputs of the slow change amount extractor 23 work such that only the component that changes relatively slowly is extracted from the change in the outputs of the adder 24. The output levels of the slow change amount extractor 23 indicate the properties of noises. When an unvoiced period is taken over by a voiced period, an immediately preceding output is retained.

The configurations and operations described above provide the following advantages:

1. The properties of ambient noises can be inferred by chasing the maximum power values and the minimum power values to check the change in the difference therebetween.

2. The voiced period determiner functions to inhibit the maximum power value chaser from erroneously chasing maximum power values in a voiced period, so that only the properties of actual ambient noises can be accurately inferred.

3. The slow change amount extractor make s it possible to obtain a value that slowly changes and can be used to identify the property of a noise among from a differential change of the maximum and minimum power values. Moreover, in a voiced period, the voiced period determiner is capable of continuously outputting values indicative of the properties of noises that have been obtained in an immediately preceding unvoiced period.

4. Processing can be accomplished in a small operational processing volume without the need of using FFT.

FOURTH OPERATIVE EXAMPLE

In a fourth operative example, a configuration example of the voiced period determiner 20 shown in FIG. 5 will be discussed.

Figure 8:
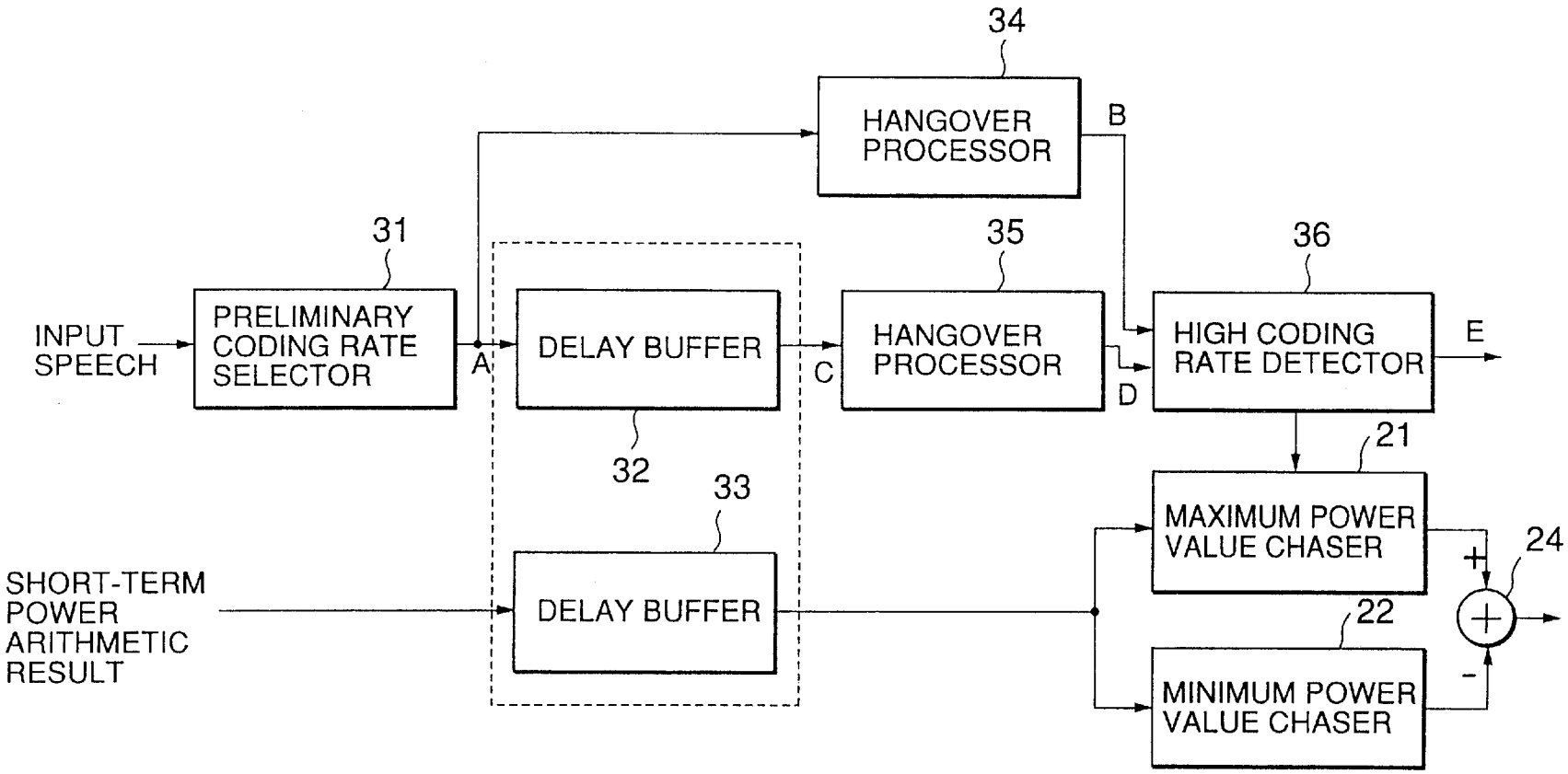
FIG. 8 is a block diagram showing an example of the configuration of a voiced period determiner.

FIG. 8 is a block diagram showing an example of the configuration of the voiced period determiner.

In this configuration, input speeches are not directly used; instead, the outputs of the short-term power arithmetic unit 2 and the outputs of a preliminary coding rate selector 31 are used to determine voiced periods.

The preliminary coding rate selector 31 is similar to the power comparator provided in a conventional speech coding rate selector.

Delay buffers 32 and 33 are formed of shift registers or the like, and input signals are shifted therein for each frame, then the signals are output after a time corresponding to a fixed number of frames elapses.

The delay buffers 32 and 33 function to delay a preliminary coding rate selection result and a short-term power arithmetic result to be supplied to the entire voiced period determiner by about a few frames to about ten frames in order to refer to past arithmetic results. A hangover processor 34 to be discussed hereinafter, however, skips the delay buffer 32 and obtains a preliminary coding rate selection result so as to enable itself to preread a signal in a "virtual future" with respect to the outputs of the delay buffers 32 and 33. In this operative example, the frame delay of the delay buffers is set to ten frames.

The hangover processor 34 and another hangover processor 35 function to enable a high coding rate detector 36, which will be discussed hereinafter, to refer to the results of the preliminary coding rate selection in the past or the virtual future with respect to an actual voiced period, over a width of a fixed number of frames. The hangover length is set to the same value as the delay of the foregoing delay buffer 32.

The hangover processor 34 retains the history of supplied coding rate selection results. When a maximum coding rate has been received, if it receives a coding rate lower than the maximum coding rate, then it holds the maximum coding rate and continues to output it for a predetermined hangover time.

The high coding rate detector 36 refers to a preliminary coding rate selection result, and provides an output indicating that the present frame corresponds to a voiced period only when the selection result reveals a high coding rate (e.g. 8 kilobits per second) that corresponds to a voiced period; for other frames, the high coding rate detector 36 provides an output indicating that the frames correspond to unvoiced periods. The high coding rate detector 36 is characterized in that it determines voiced periods by referring to a high coding rate period over a total of 21 frames consisting of the past ten frames and another ten frames in the virtual future in addition to the present frame (it should be noted that the frame is actually the one located ten frames before since the signal supplied to the entire voiced period determiner is delayed by ten frames in advance), as the preliminary coding rate selection result.

Figure 9:
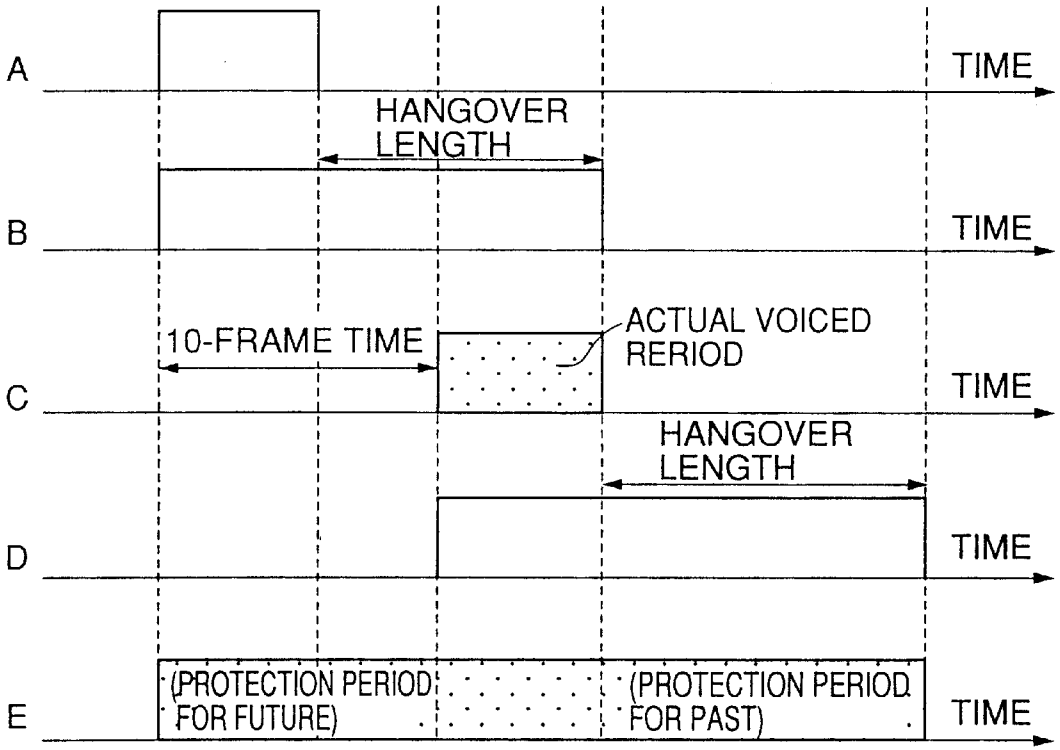
FIG. 9 is an operation time chart of the voiced period determiner.

FIG. 9 shows an operation time chart, signals A through E being shown also in FIG. 8.

In the output of the preliminary coding rate selector, the portion of the coding rate corresponding to the voiced period is shown in the form of a square wave as indicated by A of FIG. 9. The hangover processor 34 continues an output as if a voiced period were still lasting by the hangover length (10 frames) even after the voiced period is over. This is illustrated by B in FIG. 9.

The delay buffer 32 outputs the wave A by delaying it by ten frames. Applying the hangover to this result provides the wave D.

Lastly, the high coding rate detector 36 takes the logical sum of the voiced period information regarding the wave B and the voiced period information regarding the wave D to output the wave E.

As a result, it can be seen from the comparison of the wave C with the wave E, the voiced period determiner 20 supplies an output indicative of a voiced period that is actually extended by protective time widths preceding and following the voiced period. This works to inhibit the maximum power value chaser from erroneously chasing a maximum power value in a voiced period.

The protective time widths cause the maximum power value chaser 21 to recognize an unvoiced period as shorter than its actual length. This is because misjudging a voiced period as an unvoiced period leads to more significant deterioration in the performance of the maximum power value chaser 21 than misjudging an unvoiced period as a voiced period.

Although the entire operation of the voiced period determiner 20 is delayed due to the delay buffers 32 and 33, the delay merely causes the delay of the entire output of the ambient noise property inferring unit 6 because both the maximum power value chaser 21 and the minimum power value chaser 22 operates, delaying by the same delay amount. Besides, the ambient noise property inferring unit 6 itself exhibits an extremely slow output change, so that some delay does not develop into a serious problem. The operative example is configured and operated as described above since misjudging a voiced period as an unvoiced period leads to worse results.

While the voiced period determiner is indicating a voiced period, the maximum power value chaser 21 is not allowed to chase a maximum power value of an ambient noise, and when a chase result in an unvoiced period is held, engaging in the maximum power value chase at the moment of switching from a voiced period to an unvoiced period. For this reason, the maximum power value chaser 21 is designed so that the value captured by the maximum power value chaser 21 is automatically decreased to a minimum possible value. This causes the difference between the output of the maximum power value chaser 21 and that of the minimum power value chaser 22 to become a negative value; however, the influence is eliminated by a block 37, namely, a maximum value arithmetic unit, of the slow change amount extractor.

The configuration and the operation described above provide the following advantages:

1. The functions of the delay buffers and the hangover make it possible to detect, as a voiced period, a broader time range for past and virtual future than the actual voiced period. This reduces the danger of misjudging a voiced period as an unvoiced period, which will lead to improper operation of the ambient noise property inferring unit.

2. The use of the outputs of the preliminary coding rate selector makes it possible to output the information regarding a voiced period, which is required by the ambient noise property inferring unit, by a small circuit scale or a small operational processing volume.

Fifth Operative Example

In a fifth operative example, a configuration example of the slow change amount extractor 23 shown in FIG. 5 will be described.

Figure 10:
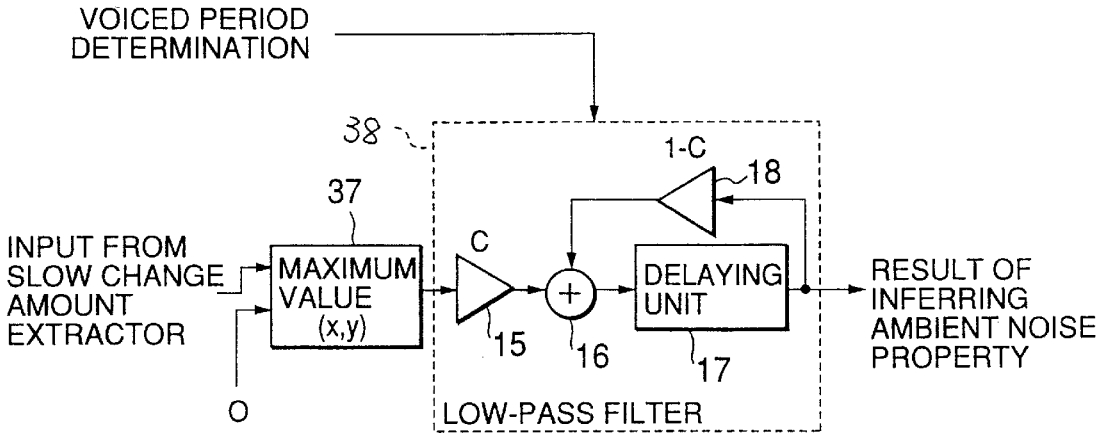
FIG. 10 is a block diagram showing an example of the configuration of a slow change amount extractor.

FIG. 10 is a block diagram showing an example of the configuration of the slow change amount extractor.

A block 37 outputs an input signal that has a larger value between two input signals. The block indicated by the dashed line is a low-pass filter 38. A result supplied by the voiced period determiner 20 is used for the operation switching control. The internal circuit is identical to that shown in FIG. 4; hence, the same reference numerals as those of FIG. 4 are used in the internal circuit.

The block 37 receives, as an input, a differential signal of the maximum power value chaser 21 and the minimum power value chaser 22 of the ambient noise property inferring unit 6 shown in FIG. 5. The block 37 outputs the value of the input if the input is 0 or more, while it outputs 0 if the input is below 0, thereby excluding negative differences.

The low-pass filter 38 operates only in an unvoiced period; it stops working in a voiced period and repeatedly outputs the received values of preceding samples. At this time, the internal state of the delaying unit is not updated, and the values of the preceding samples is retained. If an ambient noise is a white noise, then there should be hardly a change with time, so that the foregoing differential signal is small. In contrast to this, if the ambient noise is an automotive noise, then the level of the differential signal greatly varies. These results are smoothed by the low-pass filter 38 and the slow change component is output.

The configuration and operation described above provide the following advantages:

1. The low-pass filter makes it possible to extract only a slowly changing component out of the differential signal of the maximum power value chaser 21 and the minimum power value chaser 22 of the ambient noise property inferring unit 6.

2. When a voiced period lasts for a long time, the foregoing differential signal may reach a negative value. The restrictions placed on the values of 0 or more prevent the input to the low-pass filter from becoming too small.

3. The use of the outputs of the voiced period determiner 20 to control the low-pass filter 38 makes it possible to retain the value held by the delaying unit in the filter so that it is not updated during a voiced period wherein the foregoing differential signal is not indicative the property of an ambient noise. Therefore, the ambient noise property inferring result obtained until immediately before a voiced period is continuously output as it is, thus permitting stable operation of the comparison power corrector 7 shown in FIG. 1.

SIXTH OPERATIVE EXAMPLE

The following will give a specific example wherein a rate selection threshold value for distinguishing between a voiced period and an unvoiced period is dynamically changed.

Figure 11:
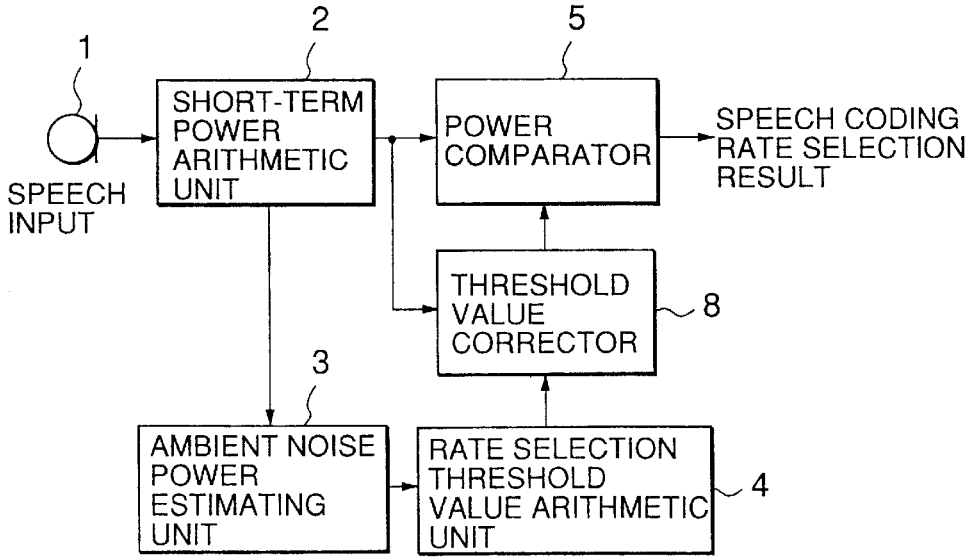
FIG. 11 is a block diagram of a speech coding rate selector of a sixth operative example.

FIG. 11 is a block diagram of a speech coding rate selector according to the sixth operative example.

A threshold value corrector 8 corrects the rate selection threshold value output from a rate selection threshold value arithmetic unit 4 according to a change in the information output from the short-term power arithmetic unit 2. The rest of the speech coding rate selector is identical to the speech coding rate selector that has been described with reference to FIG. 2.

The threshold value corrector 8 adjusts only a threshold value T2 among the rate selection threshold values output from the rate selection threshold value arithmetic unit 4. The value T2 is used for separating a group of coding rates to be used in voiced periods and a group of coding rates to be used in unvoiced periods. Some speech coding apparatuses employing the results of the speech coding rate selection are equipped with a function for suppressing the speech signal level.

The speech coding apparatuses suppress speech signals in unvoiced periods in order to reduce audible noises. The suppressing function is controlled such that it is actuated when the speech coding rate is 2 kilobits per second or 1 kilobits per second. Hence, if the result of speech coding rate determination frequently switches between 4 kilobits per second and 2 kilobits per second, then the suppressing function is actuated intermittently. Thus, if the property of an ambient noise coming in during an unvoiced period exhibits a considerable level change, then the threshold value T2 separating the voiced period and the unvoiced period is frequently crossed over even in the unvoiced period, causing frequent changes in the ambient noise level, which is offensive to the ears.

The threshold value corrector 8 refers to the outputs of the short-term power arithmetic unit 2 to adjust only the threshold value T2 for separating the voiced period and the unvoiced period thereby to reduce the frequency at which the short-term power arithmetic results cross over the threshold value.

More specifically, when the output from the short-term power arithmetic unit 2 is low, the threshold value corrector 8 adjusts the threshold value T2 to be a slightly higher value. Thus, even if the input speech signal level slightly rises, it will not immediately exceed the threshold value T2, making it difficult for the coding rate to be rounded up.

The configuration and the operation described above provide the following advantages:

1. In a case where an ambient noise has been input to a microphone and the property of the ambient noise exhibits a significant level change, only the threshold value for separating the coding rates to be used in voiced periods and the coding rates to be used in unvoiced periods is corrected according to the power of an input speech. This makes it possible to control the problem in which the speech level suppressing function in a speech coding apparatus is rendered invalid.

2. In addition, the frequency of switching ON/OFF the speech level suppressing function is reduced thereby to inhibit the offensive noise to the ears.

SEVENTH OPERATIVE EXAMPLE

Figure 12:
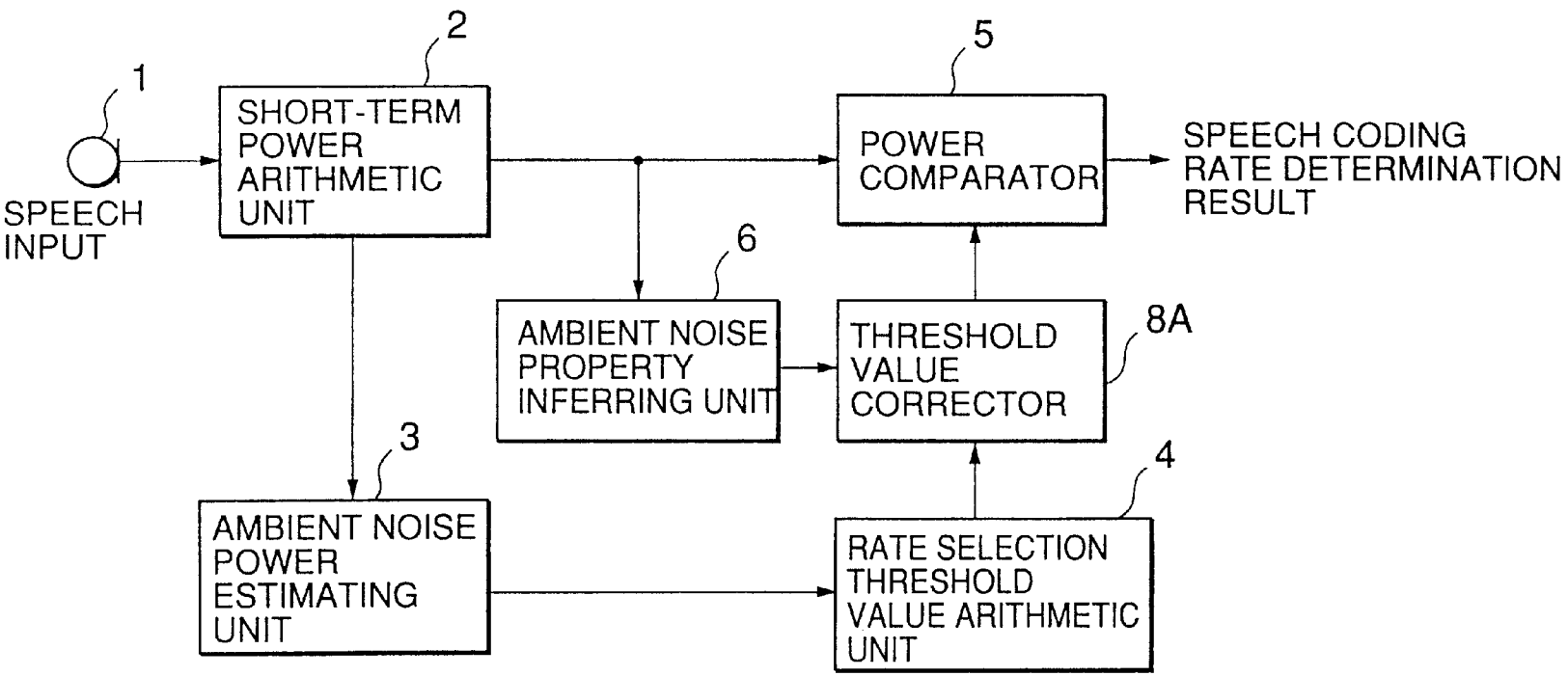
FIG. 12 is a block diagram of a speech coding rate selector of a seventh operative example.

FIG. 12 is a block diagram of a speech coding rate selector of a seventh operative example.

In this operative example, the speech coding rate selector is combined with the ambient noise property inferring unit 6 that has been discussed in conjunction with FIG. 1 so as to correct the coding rate selection threshold value in accordance with the property of an ambient noise. The rest of the speech coding rate selector in the seventh operative example is identical to that shown in FIG. 11.

If the property of an ambient noise entered through a microphone causes the short-term power arithmetic results to cross over a coding rate selection threshold value T2 that separates a voiced period and an unvoiced period, then a threshold value corrector 8A increases the threshold value to bring it closer to T1. This makes it difficult to select the coding rates for a voiced period.

More specifically, the seventh operative example carries out control so as not to cause the coding rates for a voiced period frequently to be selected due mainly to the input of automotive noises in an unvoiced period. Therefore, if the output level of the ambient noise property inferring unit 6 is increased due to the input of an automotive noise, then the threshold value T2 is changed to a slightly higher value. Thus, even if the output of the short-term power arithmetic unit 2 slightly increases, the level does not easily exceed the threshold value T2, controlling the change of the coding rate.

The configuration and operation described above provide the following advantages:

1. If the property of an ambient noise is unlikely to cause a speech coding rate selector to make misjudgment, then a threshold value is not adjusted, thereby enabling the speech coding rate selector to operate just like a conventional one. This allows the same speech coding rates as the conventional ones to be used.

2. If the property of an ambient noise is likely to cause the speech coding rate selector to make misjudgment, then the threshold value for selecting speech coding rates is adjusted. This permits the threshold value correction in the sixth operative example to be implemented by using an output value of the ambient noise property inferring unit 6.

Eighth Operative Example

Figure 13:
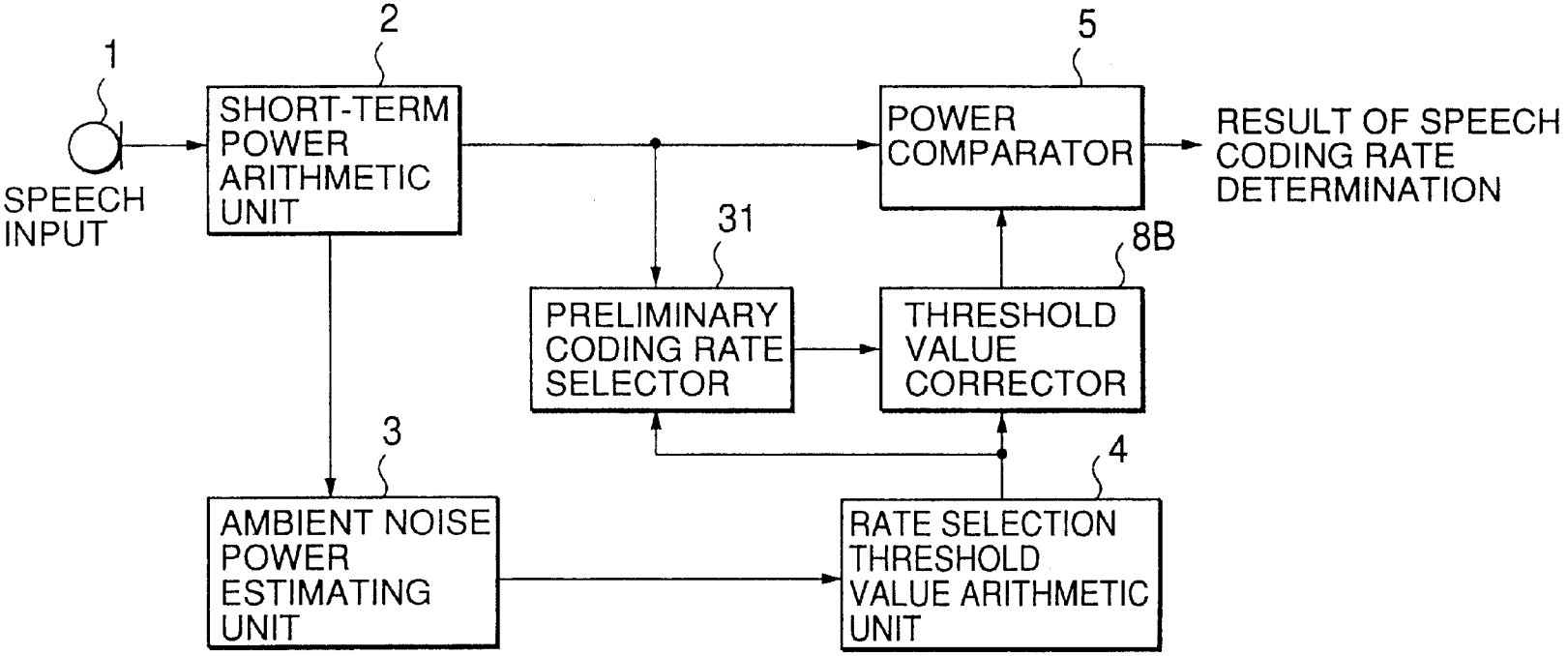
FIG. 13 is a block diagram of a speech coding rate selector of an eighth operative example.

FIG. 13 is a block diagram of a speech coding rate selector of an eighth operative example. This operative example is combined with the preliminary coding rate selector 31 discussed in conjunction with FIG. 8 so as to correct a coding rate selection threshold value according to the history of recent preliminary coding rates. The rest of the eighth operative example is identical to the speech coding rate selector shown in FIG. 11.

The preliminary coding rate selector 31 is similar to the power comparator provided in a conventional speech coding rate selector, and the configuration thereof is as discussed previously.

A threshold value corrector 8B saves the results of preliminary coding rate selection as a history to adjust the threshold value for separating a voiced period and an unvoiced period among the coding rate selection threshold values output from the rate selection threshold value arithmetic unit 4 to a value lower than its original value if recent preliminary coding rates are going higher. At this time, the switching from a voiced period to a unvoiced period is controlled.

Conversely, if recent preliminary coding rates are going lower, then the threshold value corrector 8B adjusts the threshold value for separating a voiced period and an unvoiced period to a value higher than its original value. At this time the switching from an unvoiced period to a voiced period is controlled.

The configuration and operation described above provide the following advantage:

1. Of the coding rate selection threshold values, the threshold value for separating voiced periods and unvoiced periods can be provided with a hysteresis characteristic, which inhibits short-term power arithmetic results from frequently crossing over the threshold value. Thus, the advantages described in the sixth operative example can be obtained.

NINTH OPERATIVE EXAMPLE

Figure 14:
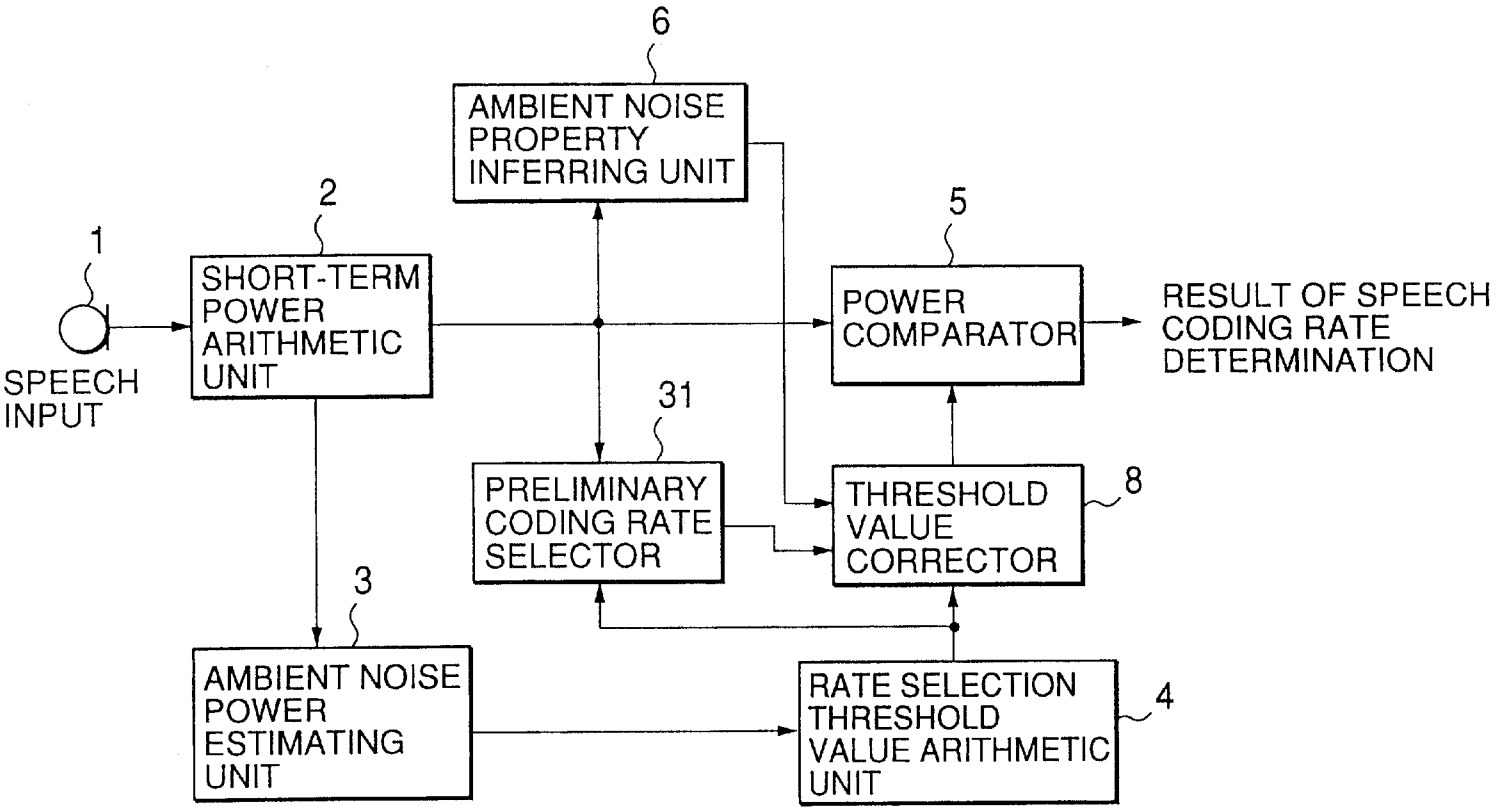
FIG. 14 is a block diagram of a speech coding rate selector of a ninth operative example.

FIG. 14 is a block diagram of a speech coding rate selector block of a ninth operative example.

The ninth operative example combines the seventh and eighth operative examples already described.

The operation of this example, therefore, combines the operations of the seventh and eighth examples already described.

Combining the seventh and eighth operative examples provide the following new advantage:

1. Of the coding rate selection threshold values, the threshold value for separating voiced periods and unvoiced periods can be provided with a hysteresis characteristic, and the hysteresis characteristic can be adjusted according to the property of an ambient noise. Therefore, if the property of a particular ambient noise is unlikely to cause a speech coding rate selector to make misjudgment, then the threshold value is not adjusted, thus enabling the speech coding rate selector to operate like a conventional one. In case of an ambient noise such as an automotive noise, hysteresis control will be enhanced to control the switching of a coding rate.

TENTH OPERATIVE EXAMPLE

In this operative example, a configuration example of a threshold value determiner shown in FIG. 12 through FIG. 14 will be described.

Figure 15:
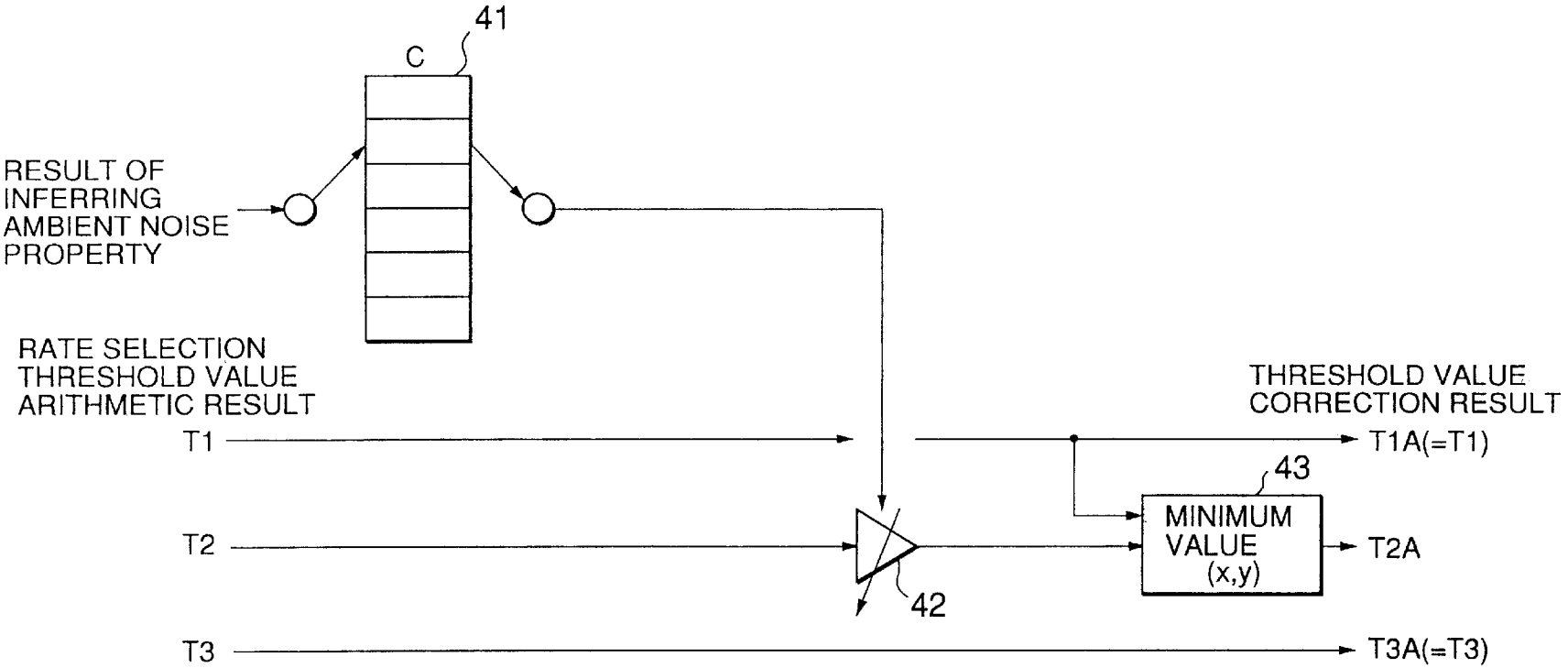
FIG. 15 is a block diagram showing an example of the configuration of a threshold value corrector (8A) described in conjunction with FIG. 12.

FIG. 15 is a block diagram showing an example of the configuration of a threshold value corrector 8A described in conjunction with FIG. 12.

A table 41 is used to determine a parameter C from the result supplied by an ambient noise property inferring unit 6 by searching the table. The parameter C takes a value of 1 or more. A multiplying unit 42 multiplies only a threshold value T2, among coding rate selection threshold values, by an output result obtained from the table 41. The threshold value T2 separates the coding rate (4 kilobits per second in this example) to be used for a voiced period and a coding rate (2 kilobits per second in this example) to be used for an unvoiced period.

A block 43 limits the value of a threshold value T2A so that it does not exceed a threshold value T1. In this case, the threshold value T1 separates the coding rate of 8 kilobits per second and the coding rate of 4 kilobits per second.

The table 41 employs the results supplied by the ambient noise property inferring unit 6 when searching the table, then outputs the obtained value to the multiplying unit 42.

The multiplying unit 42 multiplies the threshold value T2 by the result obtained from the table search and outputs the multiplied result.

The block 43 compares the threshold value T1 with the output of the multiplying unit 42, and outputs a smaller value in order to ensure that a threshold value T2A takes a value of a threshold value T1A or less, thereby restricting the upper limit of T2 to T1.

Accordingly, when an ambient noise is a white noise, the multiplying unit 42 produces an output approximating to T2×1 to maintain T2 at an initial value. On the other hand, when an ambient noise is an automotive noise, the multiplying unit produces an output of T2×2 to increase the threshold value T2.

The configuration and operation provide the following advantages:

1. Of the coding rate determination threshold values, T1 and T3 indicative of the threshold values for separating a plurality of coding rates in a voiced period or an unvoiced period are not changed. This means that unnecessary corrections of threshold values are not made.

2. When the property of an ambient noise is unlikely to cause the speech coding rate selector to make misjudgment, no correction is added to a threshold value. This allows the speech coding rate selector to operate in the same manner as a conventional one, so that the same conventional speech coding rates can be used.

3. The use of the table search permits operation to be implemented at a small circuit scale or a small arithmetic processing volume.

ELEVENTH OPERATIVE EXAMPLE

Figure 16:
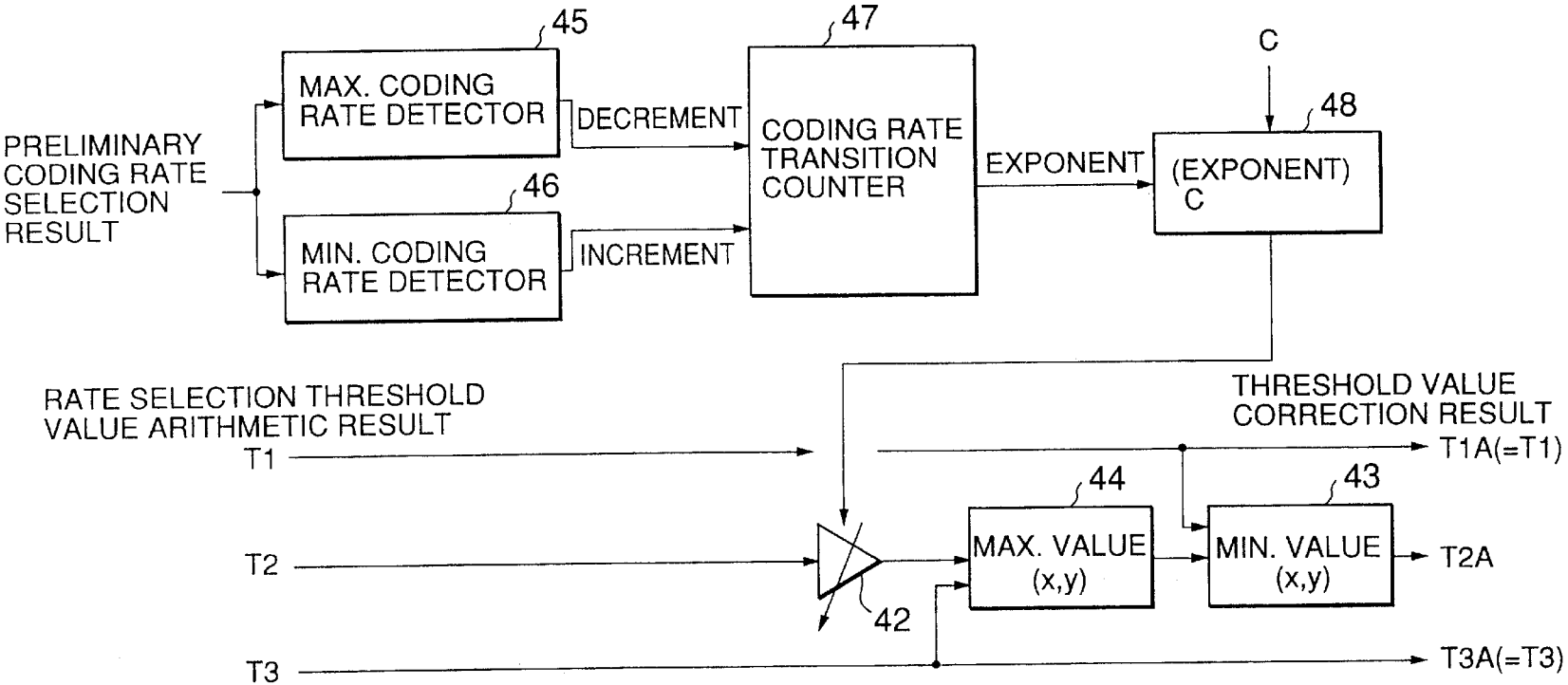
FIG. 16 is a block diagram showing an example of the configuration of a threshold value corrector (8B) described in conjunction with FIG. 13.

FIG. 16 is a block diagram showing an example of the configuration of the threshold value corrector 8B described in conjunction with FIG. 13.

A maximum coding rate detector 45 issues a decrement instruction to a counter 47, which will be discussed later, only if the result of preliminary coding rate selection indicates a maximum coding rate (8 kilobits per second in this example). A minimum coding rate detector 46 issues an increment instruction to the counter 47, which will be discussed later, only if the result of preliminary coding rate selection indicates a minimum coding rate (1 kilobits per second in this example).

The coding rate transition counter 47 increments or decrements the value in the counter in response to the increment or decrement instruction received from the maximum coding rate detector 45 or the minimum coding rate detector 46. The counter, however, has a maximum limit value and a minimum limit value, so that it simply ignores an instruction that deviates from the limit values. An exponent arithmetic unit 48 computes the value of its input C, namely, the exponential multiplier of C, and outputs the arithmetic result, C taking a predetermined value of 1 or more.

A multiplying unit 42 multiplies only a threshold value T2, among coding rate selection threshold values, by an output result supplied by the exponent arithmetic unit 48. The threshold value T2 separates the coding rate (4 kilobits per second in this example) to be used for a voiced period and a coding rate (2 kilobits per second in this example) to be used for an unvoiced period.

Blocks 44 and 43 limit the threshold value T2 so that it neither exceeds a threshold value T1 nor goes below a threshold value T3. In this case, the threshold value T1 separates the coding rate of 8 kilobits per second and the coding rate of 4 kilobits per second, and the threshold value T3 separates the coding rate of 2 kilobits per second and the coding rate of 1 kilobits per second.

Once for each frame, the maximum coding rate detector 45 sends the decrement instruction to instruct the coding rate transition counter 47 to decrement the count value if the result of preliminary coding rate selection is a maximum coding rate.

Once for each frame, the minimum coding rate detector 46 sends the increment instruction to instruct the coding rate transition counter 47 to increment the count value only by 1 if the result of preliminary coding rate selection is a minimum coding rate.

The coding rate transition counter 47 increments or decrements the value in the counter in accordance with the increment or decrement instruction received from the maximum coding rate detector 45 or the minimum coding rate detector 46. The counter, however, has a maximum limit value and a minimum limit value, so that it simply ignores an instruction that deviates from the limit values. In this case, setting the minimum limit value to a negative constant enables the counter to take a negative output value. The counter outputs a count value, which is an exponent.

The exponent arithmetic unit 48 computes the value of a constant C, namely, the exponential multiplier of C, and outputs the arithmetic result. If the output of the counter 47 is a negative value, then the output of the exponent arithmetic unit 48 will take a value below 1.

The multiplying unit 42 multiplies the threshold value T2 by the value and outputs the result.

The block 44 compares the output of the multiplying unit 42 with the threshold value T3 and outputs a larger value. In other words, the block 44 ensures that a threshold value T2A is not less than a threshold value T3A.

The block 43 compares the output of the block 44 with the threshold value T1 and outputs a smaller value. In other words, the block 43 ensures that the threshold value T2A is not more than a threshold value T1A.

Accordingly, if maximum coding rates continue, then the count value of the coding rate transition counter 47 decreases until, for example, it reaches a negative value. This causes the multiplying unit 42 to perform calculation such as T2×0.6 so as to decrease the threshold value T2, thus maintaining more stable coding rates in voiced periods. Conversely, if minimum coding rates continue, then the count value of the coding rate transition counter 47 increases, so that the multiplying unit 42 perform calculation such as T2×3 so as to increase the threshold value T2, thus maintaining more stable coding rates in unvoiced periods.

The configuration and operation described above provide the following advantages:

1. Of the coding rate determination threshold values, the threshold values, namely, T1 and T3, for separating a plurality of coding rates in voiced periods or unvoiced periods are not changed. This means that no correction is added to threshold values unless it is necessary.

2. The operation can be accomplished with a small circuit scale or a small arithmetic processing volume by monitoring the history of past coding rates by using the counter.

TWELFTH OPERATIVE EXAMPLE

Figure 17:
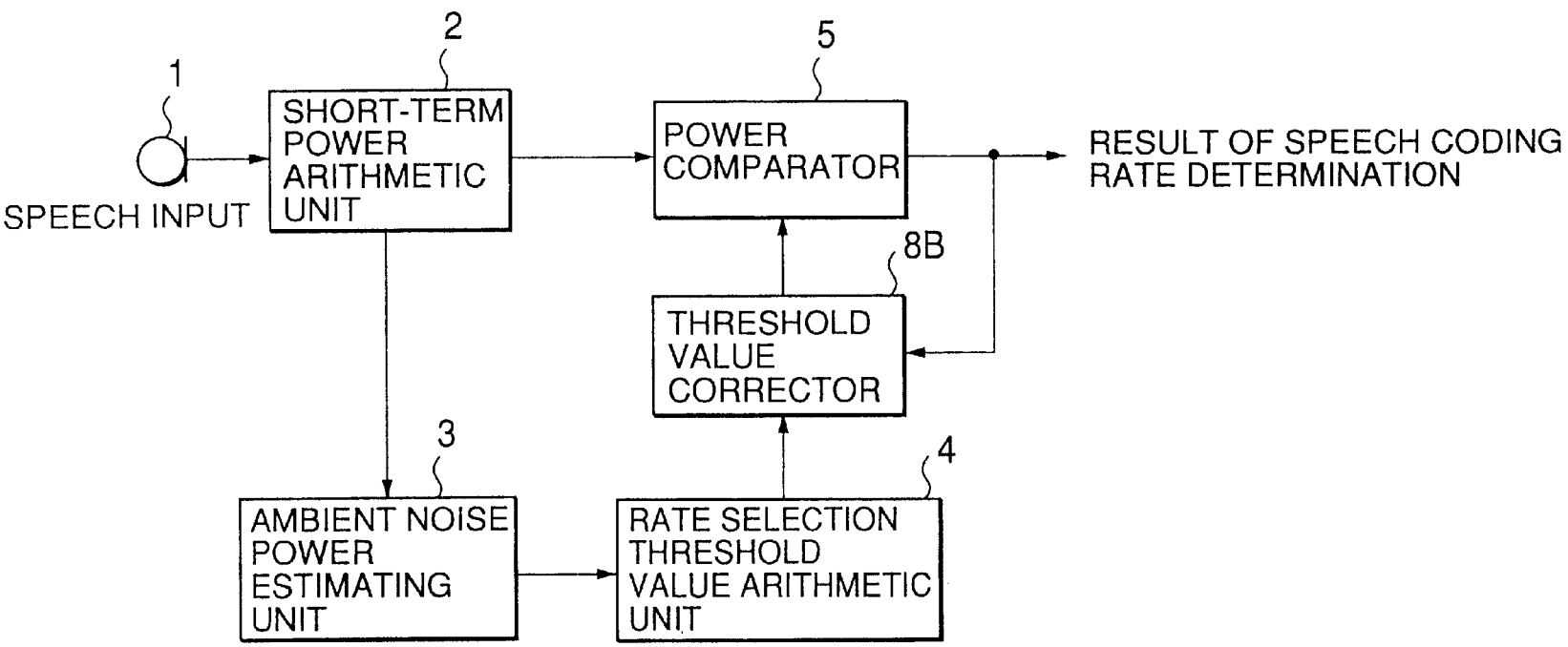
FIG. 17 is a block diagram showing a speech coding rate selector of a twelfth operative example.

FIG. 17 is a block diagram of a speech coding rate selector of a twelfth operative example.

This example utilizes the features of the operative examples that have already been described to demonstrate that the eighth operative example can be simplified.

In the eleventh operative example, only maximum coding rates and minimum coding rates are involved in the operation of a coding rate transition counter 47. Because of the configuration and operation of the example, no correction is added to a threshold value T1 involved in the selection of maximum coding rates and a threshold value T3 involved in the selection of minimum coding rates among the coding rate selection threshold values. Therefore, the operation will not be affected even if the outputs of the power comparator 5 that selects actual coding rates may be directly supplied to the threshold value corrector 8B, skipping the preliminary coding rate selector 31 in the eighth operative example.

Thus, the twelfth operative example has a configuration in which the preliminary coding rate selector 31 has been eliminated from the eighth operative example.

The twelfth operative example employs the outputs of the power comparator 5 as shown in FIG. 17 in place of the outputs of the preliminary coding rate selector 31 of the eighth operative example shown in FIG. 13; except this aspect, it operates in the same manner as the eighth operative example. More specifically, if the coding rate selected immediately before is high, then the threshold value is slightly decreased, or if the coding rate selected immediately before is low, the threshold value is slightly increased thereby controlling the switching of a coding rate.

The configuration and operation described above provide the following advantage:

1. The advantage equivalent to that provided by the eighth operative example can be achieved without providing the preliminary coding rate selector.

THIRTEENTH OPERATIVE EXAMPLE

Figure 18:
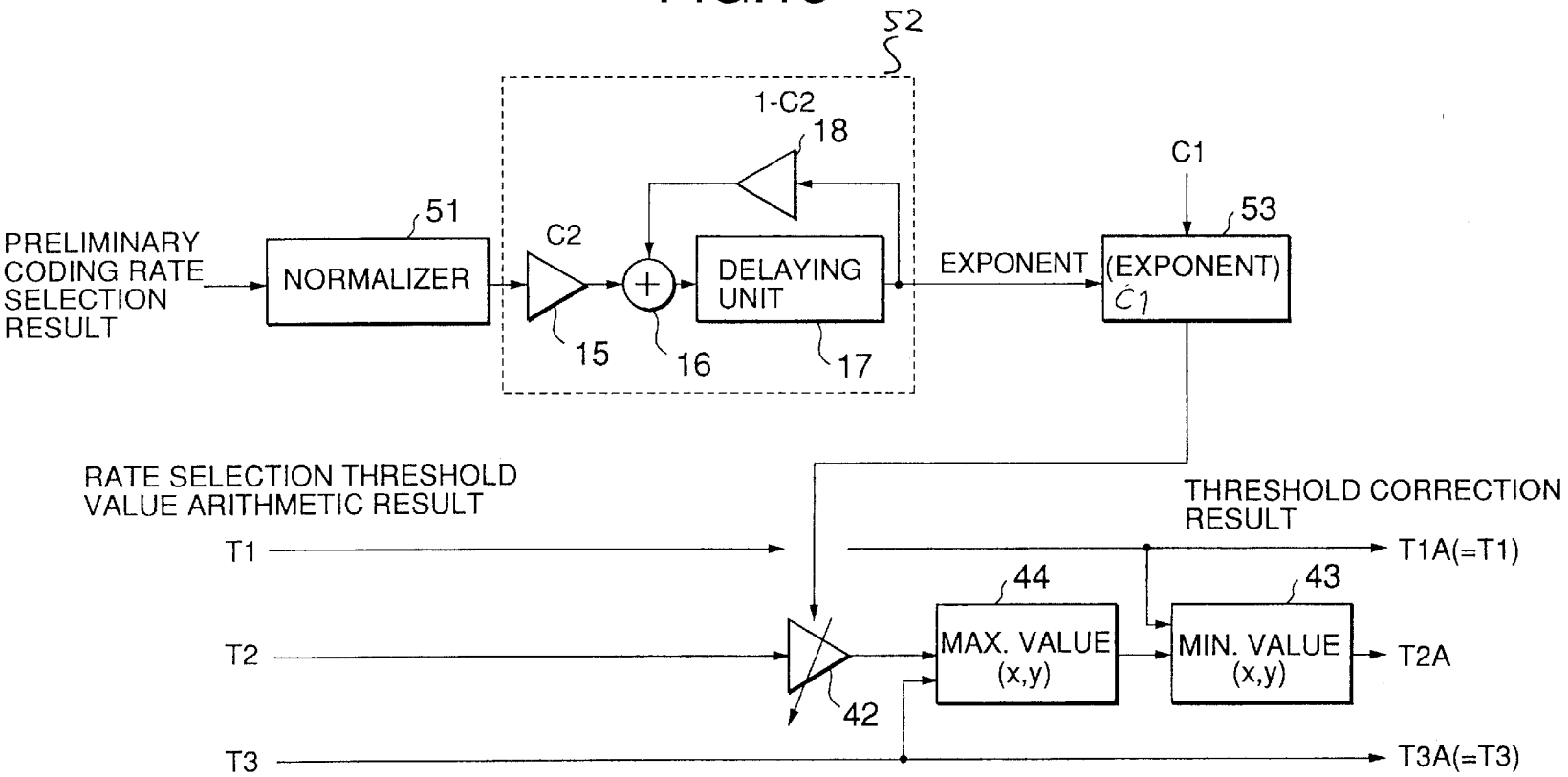
FIG. 18 is a block diagram showing an example of the configuration of the threshold value corrector (8B) used in FIG. 13.

FIG. 18 is a block diagram showing an example of the configuration of the threshold value corrector 8B used in FIG. 13.

A normalizer 51 normalizes the results of a preliminary coding rate selector to values from −1 to 1. The block enclosed by the dashed-line box denotes a low-pass filter 52. An exponent arithmetic unit 53 computes the power of the value of its input C1, that is, the exponential multiplier of C1, and outputs the arithmetic result. The exponent arithmetic unit 53 has the same function as that used in FIG. 16.

A multiplying unit 42 multiplies only a threshold value T2, among coding rate selection threshold values, by an output result obtained from the exponent arithmetic unit 53. The threshold value T2 separates the coding rate (4 kilobits per second in this example) to be used for a voiced period and a coding rate (2 kilobits per second in this example) to be used for an unvoiced period.

Blocks 44 and 43 limit the value of a threshold value T2 so that it neither exceeds a threshold value T1 nor goes below a threshold value T3. In this case, the threshold value T1 separates the coding rate of 8 kilobits per second and the coding rate of 4 kilobits per second, and the threshold value T3 separates the coding rate of 2 kilobits per second and the coding rate of 1 kilobits per second. These blocks have the same functions as those shown in FIG. 16.

The normalizer 51 normalizes the results of the preliminary coding rate selector to the values from −1 to 1. More specifically, for example, numerical values of +1, +0.5, −0.5, and −1 are assigned to four different coding rates. The outputs of the normalizer 51 changes in the range of +1 to −1 each time the coding rate to be selected is changed.

The low-pass filter 52 extracts a slow change amount from an output of the normalizer 51. The output value is an exponent.

The exponent arithmetic unit 53 computes the power of the value of a constant C1, i.e. the exponential multiplier of C1, and outputs the arithmetic result. If the output of the low-pass filter 52 is negative, then the output of the exponent arithmetic unit 53 will be a value below 1.

A multiplying unit 42 multiplies the threshold value T2 by the output of the exponent arithmetic unit 53 and outputs the result.

The block 44 compares the output of the multiplying unit 42 with the threshold value T3 and outputs a larger value. In other words, the block 44 ensures that a threshold value T2A is not less than a threshold value T3A.

The block 43 compares the output of the block 44 with the threshold value T1 and outputs a smaller value. In other words, the block 43 ensures that the threshold value T2A is not more than a threshold value T1A. Thus, the thirteenth operative example monitors past coding rates to suppress the switching of a rate just like the eleventh operative example does.

The configuration and operation described above provide the following advantages:

1. Of the coding rate determination threshold values, the threshold values, namely, T1 and T3, for separating a plurality of coding rates in voiced periods or unvoiced periods are not changed. This means that no correction is added to threshold values unless it is necessary.

2. Using the low-pass filter to monitor the history of past coding rates allows the same advantage as that of the eighth or eleventh operative example to be obtained with a small circuit scale or a small arithmetic processing volume.

FOURTEENTH OPERATIVE EXAMPLE

Figure 19:
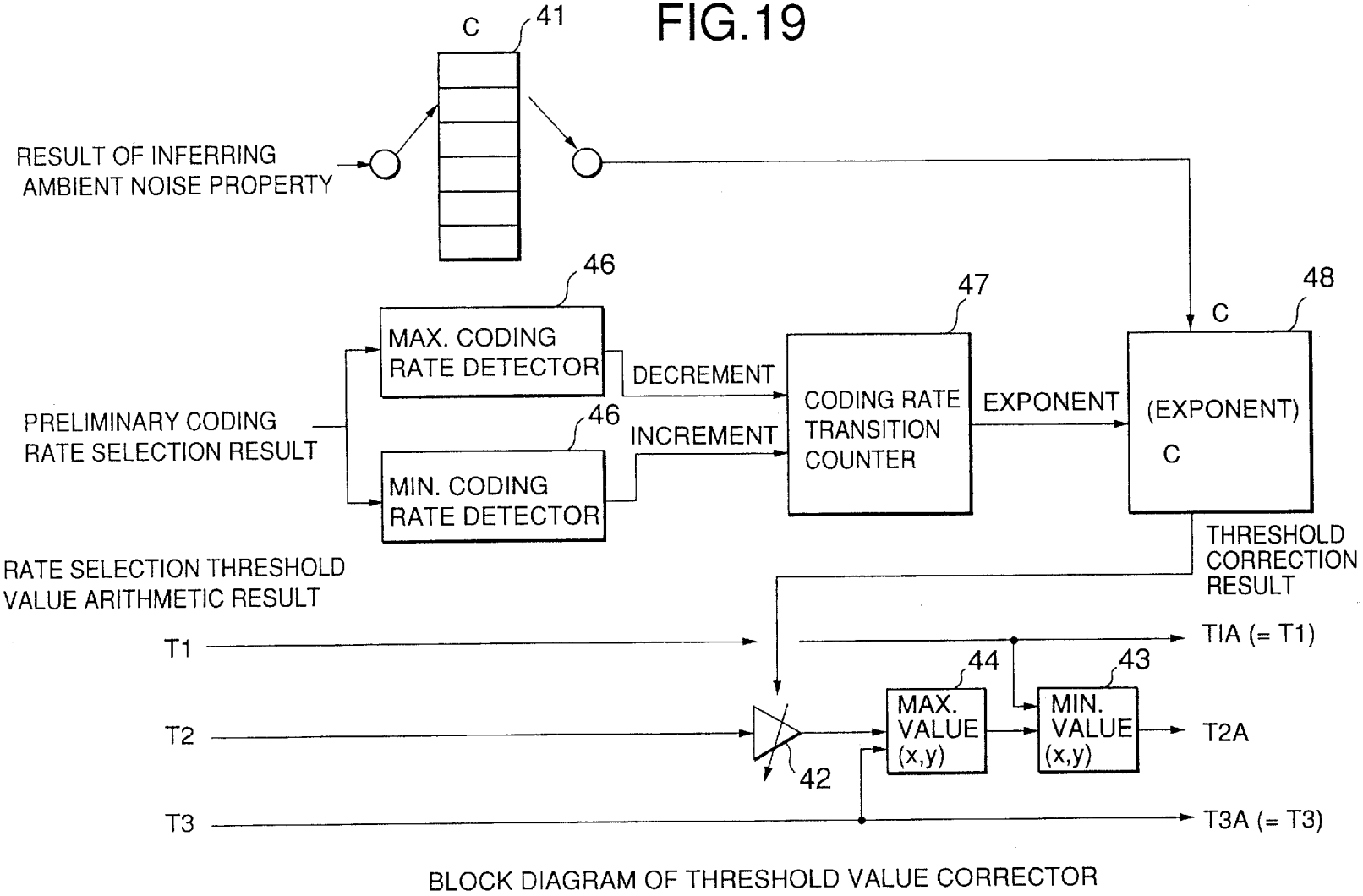
FIG. 19 is a block diagram showing an example of the configuration of the threshold value corrector (8) used in FIG. 14.

FIG. 19 is a block diagram showing an example of the configuration of the threshold value corrector 8 used in FIG. 14.

This operative example combines the tenth and eleventh operative examples already described.

The same numerals as those in the tenth and eleventh examples are assigned to the blocks in this example, and the description thereof will be omitted.

The operation of the fourteenth example, therefore, combines the operations of the tenth and eleventh examples already described.

Combining the tenth and eleventh operative examples provide the following new advantage:

1. According to an advantage of the eleventh operative example, among the coding rate selection threshold values, the threshold value for separating voiced periods and unvoiced periods can be provided with a hysteresis characteristic, and the hysteresis characteristic can be adjusted according to the property of an ambient noise. Therefore, if the property of a particular ambient noise is unlikely to cause a speech coding rate selector to make misjudgment, then the exponent C is approximated to 1 so as not to adjust the threshold value, thus enabling the speech coding rate selector to operate like a conventional one. This permits the same speech coding rates as conventional ones to be used.

FIFTEENTH OPERATIVE EXAMPLE

Figure 20:
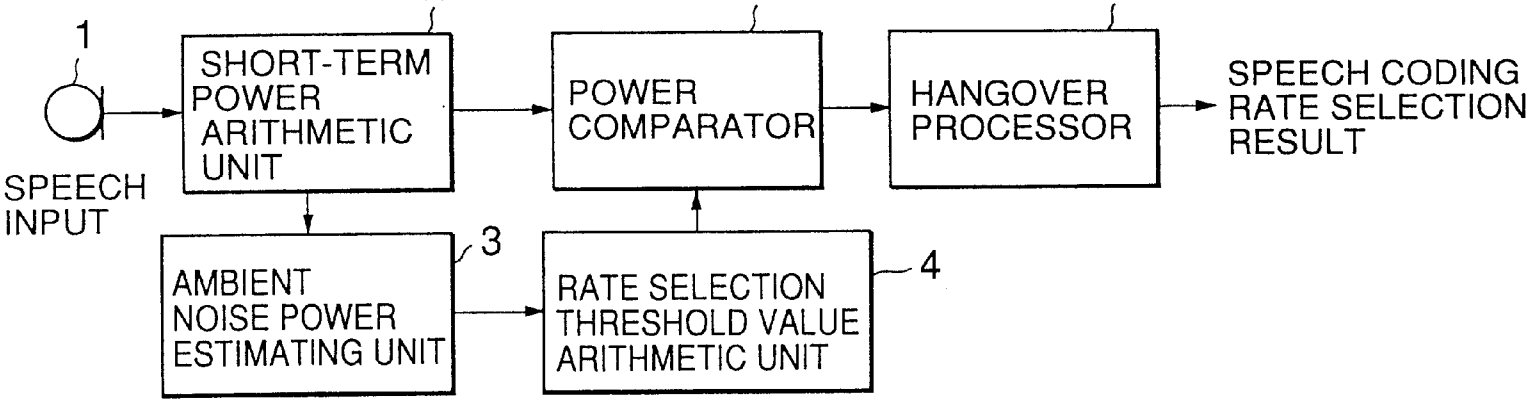
FIG. 20 is a block diagram showing a speech coding rate selector of a fifteenth operative example.

FIG. 20 is a block diagram showing a speech coding rate selector of a fifteenth operative example.

The fifteenth operative example has added a hangover processor 55 to the speech coding rate selector shown in FIG. 2.

The hangover processor 55 retains a history of the results of coding rate selection output from a power comparator 5. Once a maximum coding rate has been selected, the hangover processor 55 continues to hold the maximum coding rate only for the hangover time decided based on the results mainly of an S/N ratio presumption of an input speech when the foregoing maximum coding rate has been followed by a lower coding rate. This inhibits the ending of a word from being erroneously coded at the lower coding rate when an ambient noise is heavily superimposed on the speech.

Figure 21:
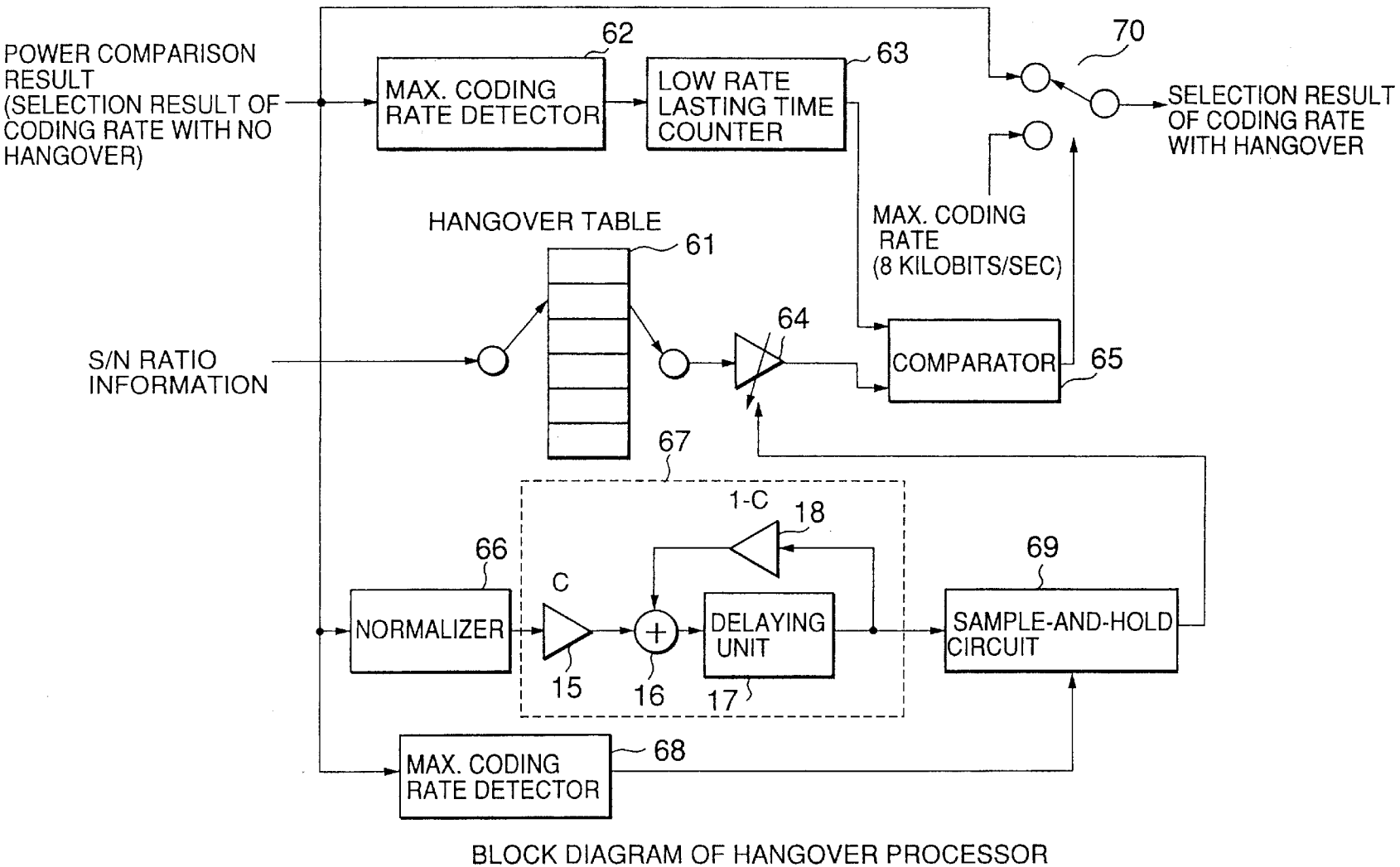
FIG. 21 is a block diagram showing a conventional hangover processor that has been improved.

FIG. 21 is a block diagram showing a hangover processor improved over a conventional one.

A hangover table 61 is used to select a hangover time based on a result supplied by an input speech S/N ratio presuming unit, which will not be described in detail herein. The hangover time is extended longer as the S/N ratio is lower.

A maximum coding rate detector 62 monitors a coding rate selection result, which is an output (not accompanied by a hangover) of the power comparator 5, and if it detects a maximum coding rate (8 kilobits per second in this example), then it produces an output to that effect. A low rate lasting time counter 63 measures the lasting time, during which a maximum coding rate has not been selected, based on a result supplied by the maximum coding rate detector 62, and outputs the measurement result. The counter 63 starts counting at the moment a maximum coding rate stops being selected, and incrementally counts the time.

A multiplying unit 64 multiplies a result from the hangover table 61 by a correction amount to be discussed hereinafter. A comparator 65 compares a result supplied by the multiplying unit 64 with an output of the low rate lasting time counter 63, and outputs the comparison result to a switch 70. If the value of a low coding rate lasting time is smaller than a value obtained by multiplying a hangover amount by a correction amount, then the switch 70 forcibly fixes the coding rate at a maximum coding rate.

A normalizer 66 normalizes coding rate selection results, which are the outputs of the power comparator, to values of 0 to 1. The normalizing process is identical to that described in the thirteenth operative example. The block enclosed by the dashed-line box denotes a low-pass filter 67 which extracts a slow change amount from the normalized outputs of the coding rate selection results.

A maximum coding rate detector 68 is identical to the maximum coding rate detector 62 and may be redundant; however, it is provided in this example. A sample-and-hold circuit 69 supplies an output of a low-pass filter 67 as it is only while a maximum coding rate is being detected; otherwise, it continues to hold an output of the low-pass filter 67 obtained at the time when the maximum coding rate was detected last recently. The outputs of the sample-and-hold circuit 69 provide the foregoing correction amounts.

The low rate lasting time counter 63 measures and outputs the time from the moment a maximum coding rate was detected last, i.e. the time during which the low coding rate continues. The value is compared with an output result from the hangover table 61, and the coding rate selected by the power comparator is replaced by a maximum coding rate and fixed to the maximum coding rate by using the switch 70 for a time in which the low coding rate lasting time is shorter than the hangover time.

In other words, while the maximum coding rate is being selected, the switch 70 supplies the outputs of the power comparator 5 as they are, whereas the switch 70 switches and fixes a coding rate at the maximum coding rate when the maximum coding rate is no longer selected. After that, the comparator 65 maintains the state of the switch until the value of the low rate lasting time counter grows larger than the value output from the multiplying unit 64. The multiplying unit 64 decides the hangover time.

This operative example is characterized in that the hangover time is corrected by the multiplying unit 64.

The normalizer 66 and low-pass filter 67 cooperate to obtain the slow change amount of a coding rate that does not involve a hangover. Based on the obtained result, if the coding rate is being continuously maintained at a high value, then a correction is set at a larger value so as to prolong the hangover time, or if the coding rate is being continuously maintained at a low value, then a correction is set at a smaller value so as to shorten the hangover.

In order to prevent the correction value from becoming smaller over time in an unvoiced period, the correction value is continuously fixed by the sample-and-hold circuit 69 while a maximum coding rate is not being selected.

The configuration and operation described above provide the following advantage:

1. The conventional hangover processor has a shortcoming in that, if a hangover state is erroneously set due to a high level of an ambient noise, then the hangover state is held for an extended time. The prolonged hangover state has been posing a problem in that a coding rate is unnecessarily increased or the speech gain suppressing function of a speech coding apparatus at a low coding rate is rendered invalid. The hangover corrector in this example employs the history of past coding rates, so that even if the hangover state is erroneously set in an unvoiced period, the hangover state can be quickly disengaged.

SIXTHENTH OPERATIVE EXAMPLE

Figure 22:
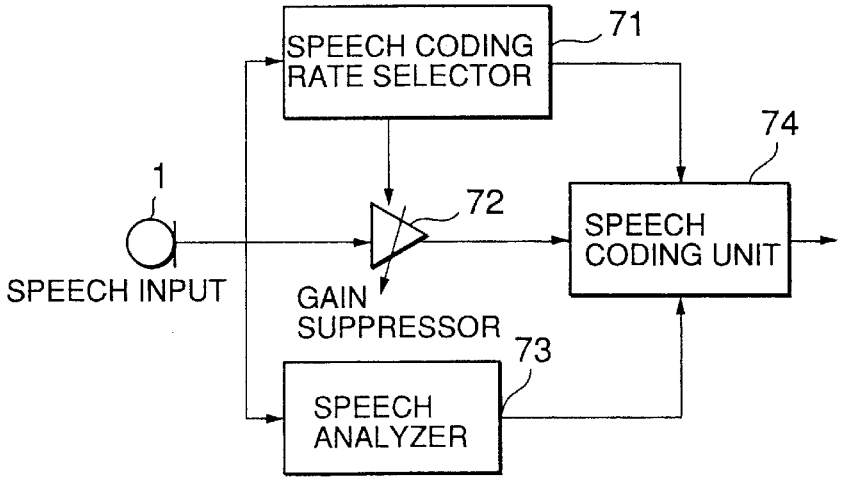
FIG. 22 is a block diagram showing a speech coding apparatus of a sixteenth operative example.

FIG. 22 is a block diagram showing a speech coding apparatus of a sixteenth operative example.

In the apparatus shown in the drawing, a gain suppressor 72 has been added to a variable-rate type speech coding rate selector 71, which is the type described above.

Normally, a speech coding apparatus with variable coding rate is formed of the speech coding rate selector 71, a speech analyzer 73, and a speech coding unit 74 in the narrow sense.

The speech analyzer 73 processes an input speech to infer the transfer function in the oral cavity in a speaker's uttering organ. In general, a parameter known as a line spectrum pair (LSP) associated with the formant frequency of voice is determined.

Based on the result supplied by the speech analyzer 73, the speech coding unit 74 in the narrow sense makes a synthesis filter based on the transfer function of the oral cavity, and generates an excitation signal of the synthesis filter such that the output of the synthesis filter approaches the actual input speech and codes the excitation signal. The coded result together with the LSP parameter are transmitted to a subsequent speech decoding apparatus, which is not shown.

Based on the information received from the speech coding rate selector 71, the gain suppressor 72 suppresses the gain of the signal applied to the speech coding unit 74 in the narrow sense in an unvoiced period. No correction is added to a signal for speech analysis, which means that a speech input is supplied as it is to the speech analyzer 73 and used for generating the LSP parameter.

The configuration and operation described above provide the following advantages:

1. When a speech coding apparatus is implemented by fixed-point arithmetic, only the gain for speech coding can be suppressed without causing deterioration in the analyzing accuracy of a speech analyzer when suppressing the gain in an unvoiced period or the like.

2. When changing a suppressed gain in steps on a time axis, it is possible to prevent harmonics caused of rectangular-wave generated by changing the gain from affecting a speech analyzer. Hence, LSP parameters faithful to original sounds can be generated.

SEVENTHENTH OPERATIVE EXAMPLE

Figure 23:
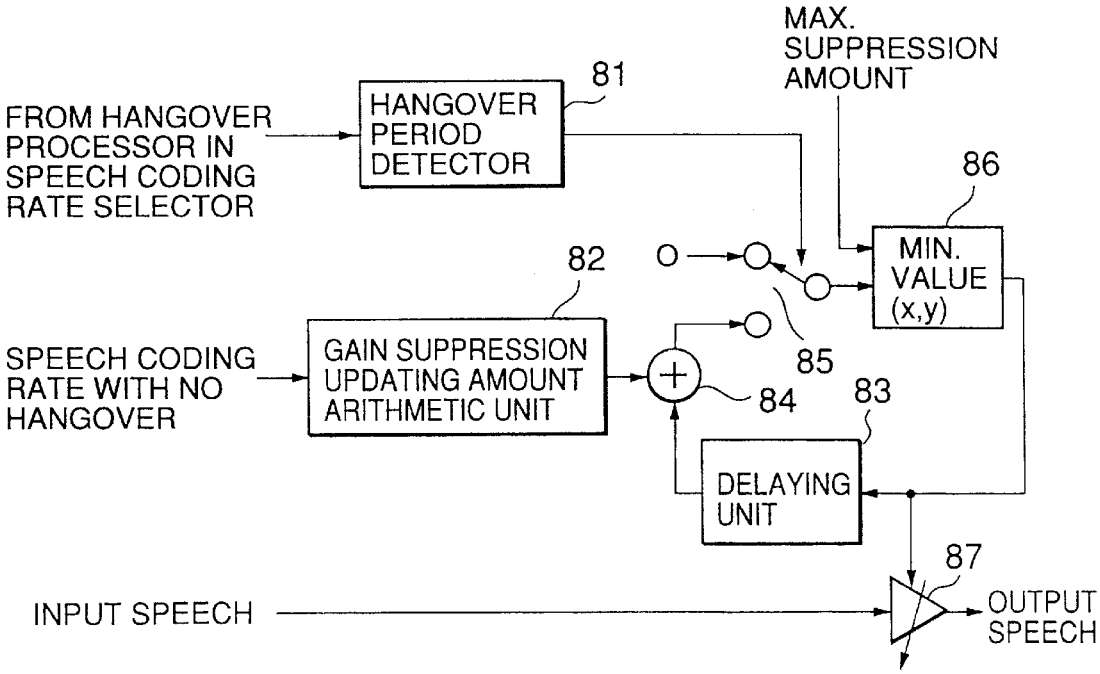
FIG. 23 is a block diagram showing an example of the configuration of a gain suppressor used in FIG. 22.

FIG. 23 is a block diagram showing an example of the configuration of the gain suppressor shown in FIG. 22.

A hangover period detector 81 receives information from the hangover processor in the speech coding rate selector, and outputs 1 in hangover periods or 0 in non-hangover periods.

Based on a speech coding rate selection result that does not involve hangover, a gain suppression updating amount arithmetic unit 82 determines the difference amount based on which the gain suppression amount is updated. Specifically, the updating amount is determined by table search.

Figure 24:
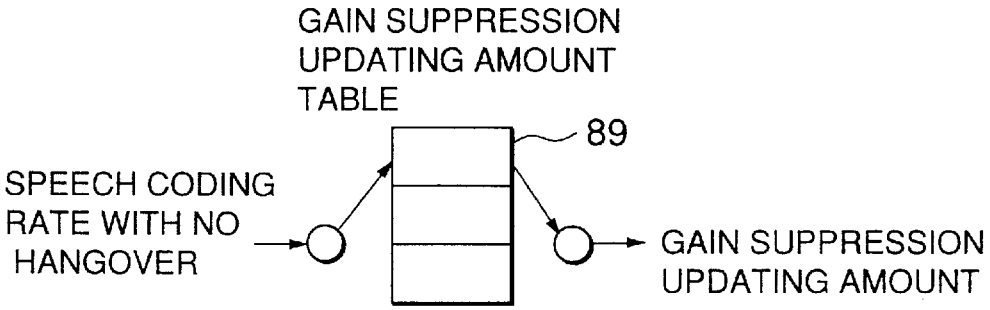
FIG. 24 is a block diagram showing an example of the configuration of an updated gain suppression arithmetic unit.

FIG. 24 is a block diagram showing a configuration example of the gain suppression updating amount arithmetic unit.

The gain suppression updating amounts corresponding to speech coding rates are taken out from a table 89 shown in FIG. 24.

A delaying unit 83 retains the gain suppression amount of one frame before. An adder 84 adds the gain suppression amount of one frame before and an output of the gain suppression updating amount arithmetic unit 82 to determine the gain suppression amount for the present frame. The suppression amount is obtained in terms of decibel (dB).

A switch 85 is changed over according to a result supplied by the hangover period detector 81. A block 86 outputs a smaller value of two inputs it receives.

A multiplying unit 87 multiplies an input speech by a gain suppression amount.

Based on a speech coding rate selection result (no hangover is involved) of the frame, the gain suppression updating amount arithmetic unit 82 determines the updating amount of the gain suppression. An actual gain suppression amount is determined by adding an output of the gain suppression updating amount arithmetic unit 82 to the gain suppression amount of the frame immediately preceding the present frame.

If a speech coding rate not involving hangover corresponds to a voiced period (4 kilobits per second), then the gain suppression updating amount takes a negative value to cut down the gain suppression amount. Conversely, if a speech coding rate not involving hangover corresponds to an unvoiced period (2 kilobits per second or 1 kilobits per second), then the gain suppression updating amount takes a positive value to increase the gain suppression amount.

In a non-hangover period, the output of the hangover period detector 81 becomes zero, and the setting of the switch 85 is changed over to the upper side. This causes the gain suppression amount to be output to the multiplying unit 87 to become zero and the gain suppression amount to input to the delaying unit 83 also to zero, thereby resetting the gain suppression amount.

The block 86 outputs a smaller value between a maximum limit value of the gain suppression amount and an output of the switch 85 so as to restrict the increment in the gain suppression amount.

The multiplying unit 87 suppresses an input speech by an output result supplied by the block 86. The gain suppression amount is given in terms of decibel (dB), so that it is converted into a linear amount prior to multiplication.

The configuration and operation described above provide the following advantages:

1. Even during a hangover period, the gain suppression amount is decided based on a speech coding rate (involving no hangover) so as to suppress input speeches. This makes it possible to reduce auditory ambient noises during the hangover in a variable amount over time.

2. In a hangover period, if a speech coding rate (involving no hangover) is high, then the gain suppression amount is reduced so as not to excessively suppress a speech in a voiced period during the hangover period.

3. The gain suppression amount can be quickly set to zero upon completion of a hangover.

What is claimed is:

1. A speech coding rate selector comprising:

a speech input unit for receiving an input speech;

a short-term power arithmetic unit for computing the power of an input speech at a predetermined time unit;

an ambient noise power estimating unit for estimating the power of an ambient noise superimposed on an input speech;

a rate selection threshold value arithmetic unit for computing a group of power threshold values for selecting a speech coding rate by using a result of the ambient noise power estimation;

a power comparator that compares the power determined by the short-term power arithmetic unit with a group of threshold values determined by the rate selection threshold value arithmetic unit to select one appropriate rate from among a plurality of speech coding rates;

an ambient noise property inferring unit for inferring the property of an ambient noise superimposed on an input speech; and a comparison power corrector for correcting an output value of the short-term power arithmetic unit if an ambient noise, the property of which has been inferred by the ambient noise property inferring unit, proves to exhibit a considerable time-dependent change in power.

2. A speech coding rate selector according to claim 1, wherein:

the comparison power corrector is formed of a low-pass filter and a level suppressor;

if the power of an ambient noise considerably changes over time, then the low-pass filter eliminates a large portion of a high-frequency component from an output of the short-term power arithmetic unit and suppressed by the level suppressor; and if the time-dependent change in the power of an ambient noise is small, then an output of the short-term power arithmetic unit is passed, nearly as it is, through the low-pass filter and the level suppressor and output.

3. A speech coding rate selector according to claim 1, wherein the ambient noise property inferring unit comprises:

a voiced period determiner that assesses an input speech signal for each predetermined time unit to determine whether the input speech signal belongs to a voiced period or an unvoiced period;

a power maximum value chaser that employs an output of the short-term power arithmetic unit and an output of the voiced period determiner for each frame to chase, on a time axis, only the change in a maximum value of the output of the short-term power arithmetic unit in an unvoiced period;

a power minimum value chaser that employs an output of the short-term power arithmetic unit for each frame to chase, on a time axis, only the change in a minimum value of the output of the short-term power arithmetic unit in an unvoiced period; and a slow change amount extractor that accepts a difference between the output of the maximum power value chaser and the output of the minimum power value chaser in order to extract a component that slowly changes from the change of the difference.

4. A speech coding rate selector according to claim 3, wherein:

the voiced period determiner is equipped with a preliminary coding rate selector that outputs coding rate information; and based on an output of the preliminary coding rate selector, the voiced period determines, as a voiced period, a period that is broader and time-wise longer than the period during which a person actually speaks within a range of a predetermined time before and after a state wherein a maximum coding rate is selected.

5. A speech coding rate selector according to claim 3, wherein:

the slow change amount extractor comprises:

a block that receives as an input a differential signal of the maximum power value chaser and the minimum power value chaser of the ambient noise property inferring unit, and if the input is zero or more, then it outputs the value of the input, or if the input is below zero, then it outputs zero; and a low-pass filter that operates only in an unvoiced period, stops operation in a voiced period, and continues to repeatedly output a value that has been output immediately before.

6. A speech coding rate selector comprising:

a speech input unit for receiving an input speech;

a short-term power arithmetic unit for computing the power of an input speech at a predetermined time unit;

an ambient noise power estimating unit for estimating the power of an ambient noise superimposed on an input speech;

a rate selection threshold value arithmetic unit for computing a group of power threshold values for selecting a speech coding rate by using a result of the ambient noise power estimation;

a power comparator that compares the power determined by the short-term power arithmetic unit with a group of threshold values determined by the rate selection threshold value arithmetic unit to select one appropriate rate from among a plurality of speech coding rates; and a threshold value corrector that refers to an output of the short-term power arithmetic unit to adjust a threshold value for separating a voiced period and an unvoiced period so as to reduce the frequency at which a result obtained by the short-term power arithmetic unit crosses over the threshold value.

7. A speech coding rate selector comprising:

a speech input unit for receiving an input speech;

a short-term power arithmetic unit for computing the power of an input speech at a predetermined time unit;

an ambient noise power estimating unit for estimating the power of an ambient noise superimposed on an input speech;

a rate selection threshold value arithmetic unit for computing a group of power threshold values for selecting a speech coding rate by using a result of the ambient noise power estimation;

a power comparator that compares the power determined by the short-term power arithmetic unit with a group of threshold values determined by the rate selection threshold value arithmetic unit to select one appropriate rate from among a plurality of speech coding rates;

an ambient noise property inferring unit that infers the property of an ambient noise superimposed on an input speech; and a threshold value corrector that refers to an output of the ambient noise property inferring unit to adjust a threshold value for separating a voiced period and an unvoiced period so as to reduce the frequency at which a result obtained by the short-term power arithmetic unit crosses over the threshold value.

8. A speech coding rate selector according to claim 7, wherein:

the threshold value corrector determines a correction value by table search on the basis of a result of inferring an ambient noise property.

9. A speech coding rate selector comprising:

a speech input unit for receiving an input speech;

a short-term power arithmetic unit for computing the power of an input speech at a predetermined time unit;

an ambient noise power estimating unit for estimating the power of an ambient noise superimposed on an input speech;

a rate selection threshold value arithmetic unit for computing a group of power threshold values for selecting a speech coding rate by using a result of the ambient noise power estimation;

a power comparator that compares the power determined by the short-term power arithmetic unit with a group of threshold values determined by the rate selection threshold value arithmetic unit to select one appropriate rate from among a plurality of speech coding rates; and a threshold value corrector that provides the threshold value for separating a voiced period and an unvoiced period with a hysteresis characteristic based on the an output of the power comparator.

10. A speech coding rate selector according to claim 9, wherein:

an ambient noise property inferring unit for inferring the property of an ambient noise superimposed on an input speech is provided; and the threshold value corrector receives an output of the ambient noise property inferring unit to adjust a hysteresis amount according to the property of the ambient noise.

11. A speech coding rate selector according to claim 9, wherein:

the threshold value corrector comprising:

a maximum coding rate detector that sends a decrement instruction to a counter mentioned hereinafter if a result of preliminary coding rate selection is indicative of a maximum coding rate;

a minimum coding rate detector that sends an increment instruction to the counter mentioned hereinafter only if a result of preliminary coding rate selection is indicative of a minimum coding rate;

a coding rate transition counter that decrements the value in the counter in response to the decrement instruction from the maximum coding rate detector, or increments the value in the counter in response to the increment instruction from the minimum coding rate detector;

an exponent arithmetic unit that implements exponential arithmetic using an output of the coding rate transition counter as an exponent; and a multiplying unit that multiplies only a threshold value for separating a coding rate to be used in a voiced period and a coding rate to be used in an unvoiced period among coding rate selection threshold values, by an output result of the exponent arithmetic unit.

12. A speech coding rate selector according to claim 9, wherein:

the threshold value corrector comprises:

a low-pass filter for eliminating a high-frequency component of a change amount in a preliminary coding rate;

an exponent arithmetic unit for multiplying a constant by the power of an output of the low-pass filter; and a multiplying unit for correcting a threshold value by an output of the exponential arithmetic unit.

13. A speech coding rate selector comprising:

a speech input unit for receiving an input speech;

a short-term power arithmetic unit for computing the power of an input speech at a predetermined time unit;

an ambient noise power estimating unit for estimating the power of an ambient noise superimposed on an input speech;

a rate selection threshold value arithmetic unit for computing a group of power threshold values for selecting a speech coding rate by using a result of the ambient noise power estimation;

a power comparator that compares the power determined by the short-term power arithmetic unit with a group of threshold values determined by the rate selection threshold value arithmetic unit to select one appropriate rate from among a plurality of speech coding rates; and a threshold value corrector that provides the threshold value for separating a voiced period and an unvoiced period with a hysteresis characteristic on the basis of an immediately preceding speech coding rate selection result.

14. A speech coding rate selector comprising:

a speech input unit for receiving an input speech;

a short-term power arithmetic unit for computing the power of an input speech at a predetermined time unit;

an ambient noise power estimating unit for estimating the power of an ambient noise superimposed on an input speech;

a rate selection threshold value arithmetic unit for computing a group of power threshold values for selecting a speech coding rate by using a result of the ambient noise power estimation;

a power comparator that compares the power determined by the short-term power arithmetic unit with a group of threshold values determined by the rate selection threshold value arithmetic unit to select one appropriate rate from among a plurality of speech coding rates; and a hangover processor that retains the history of a coding rate selection result output from the power comparator, and if a maximum coding rate that has been selected once is replaced by a lower coding rate, then it maintains the output of the short-term power arithmetic unit at the maximum coding rate only for a predetermined hangover time so as to correct a hangover amount.

15. A speech coding rate selector according to claim 14, wherein:

the hangover processor comprises:

a filter for eliminating a high-frequency component from a change amount of a coding rate not involving a hangover; and a sample-and-hold circuit that continues to fix an output of the filter if a coding rate involving no hangover is not a maximum coding rate.

* * * * *

UNITED STATES PATENT AND TRADEMARK OFFICE

CERTIFICATE OF CORRECTION

PATENT NO. : 6,360,199 B1
DATED : March 19, 2002
INVENTOR(S) : Atsushi Yokoyama

It is certified that error appears in the above-identified patent and that said Letters Patent is hereby corrected as shown below:

Title page,
Item [73], insert as follows: -- [73] Assignee: Oki Electric Industry Co., Ltd., Tokyo (JP) --

Signed and Sealed this

Twenty-fourth Day of December, 2002

JAMES E. ROGAN
*Director of the United States Patent and Trademark Office*